US011338947B2

(12) United States Patent
Palumbo

(10) Patent No.: US 11,338,947 B2
(45) Date of Patent: May 24, 2022

(54) PROCESS OF PACKAGING AND MODULAR PACKAGING FACILITY FOR PACKAGING PRODUCTS ON SUPPORTS

(71) Applicant: Cryovac, LLC, Charlotte, NC (US)

(72) Inventor: Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 215 days.

(21) Appl. No.: 16/478,254

(22) PCT Filed: Jan. 31, 2017

(86) PCT No.: PCT/EP2017/052075
§ 371 (c)(1),
(2) Date: Jul. 16, 2019

(87) PCT Pub. No.: WO2018/141372
PCT Pub. Date: Aug. 9, 2018

(65) Prior Publication Data

US 2019/0351456 A1 Nov. 21, 2019

(51) Int. Cl.
*B65B 11/52* (2006.01)
*B07C 3/18* (2006.01)
(Continued)

(52) U.S. Cl.
CPC ..... *B65B 11/52* (2013.01); *B07C 3/18* (2013.01); *B07C 5/3404* (2013.01);
(Continued)

(58) Field of Classification Search
CPC ..... B65B 11/52; B65B 59/003; B65B 59/02; B65B 43/52; B65B 59/04; B65B 31/028;
(Continued)

(56) References Cited

U.S. PATENT DOCUMENTS 2,762,720 A 9/1956 Rudolph
5,755,083 A * 5/1998 Cleine ..... B65B 25/24 53/588
2004/0028777 A1* 2/2004 Koke ..... B65B 25/065 426/129
2004/0033382 A1 2/2004 Kendig
(Continued)

FOREIGN PATENT DOCUMENTS

EP 0690012 A1 1/1996
EP 1529797 A1 5/2005
(Continued)

*Primary Examiner* — Patrick H Mackey
(74) *Attorney, Agent, or Firm* — Jon M. Isaacson

(57) ABSTRACT

A modular packaging facility has independent packaging units configured to receive one or more product loaded supports. The upper tool and the lower tool of each unit are relatively movable the one with respect to the other between at least a first position, allowing placement of the supports in the respective seats of the lower tool, and a second position, allowing coupling of a film portion of said film to said one or more product loaded supports received by the lower tool. Each unit has a vacuum arrangement and/or a controlled atmosphere arrangement and is configured to execute a packaging cycle wherein gas is removed and/or injected via holes in the supports and/or via nozzles placed between the support and the respective film portion. The process and the infrastructure may be used to contemporaneously process and pack supports of different types.

13 Claims, 24 Drawing Sheets

(51) Int. Cl.

| | |
|---|---|
| ***B07C 5/34*** | (2006.01) |
| ***B65B 59/00*** | (2006.01) |
| ***B65B 59/02*** | (2006.01) |
| *B07C 5/342* | (2006.01) |
| *B65B 43/52* | (2006.01) |
| *B65B 57/18* | (2006.01) |

(52) U.S. Cl.
CPC ..... *B65B 59/003* (2019.05); *B65B 59/02* (2013.01); *B07C 5/3422* (2013.01); *B07C 2301/0016* (2013.01); *B65B 43/52* (2013.01); *B65B 57/18* (2013.01); *B65B 2210/02* (2013.01)

(58) Field of Classification Search
CPC ..... B65B 31/043; B65B 31/06; B65B 43/06; B65B 57/00; B65B 57/08; B65B 65/006; B07C 3/18; B07C 5/3404
See application file for complete search history.

(56) References Cited

U.S. PATENT DOCUMENTS

| | | | | |
|---|---|---|---|---|
| 2009/0022860 | A1 | 1/2009 | Roveda et al. | |
| 2014/0007545 | A1* | 1/2014 | Vine | B65B 7/164 53/285 |
| 2016/0304226 | A1* | 10/2016 | Rossini | B29C 65/7882 |

FOREIGN PATENT DOCUMENTS

| | | | | |
|---|---|---|---|---|
| FR | 2975081 | A1 * | 11/2012 | B29C 66/83221 |
| FR | 2975081 | A1 | 11/2012 | |
| WO | 0216210 | A1 | 2/2002 | |
| WO | 2007093495 | A1 | 8/2007 | |
| WO | 2009141214 | A1 | 11/2009 | |
| WO | 2012107779 | A1 | 8/2012 | |
| WO | 2014060507 | A1 | 4/2014 | |
| WO | 2014166940 | A1 | 10/2014 | |
| WO | 2015086764 | A1 | 6/2015 | |

* cited by examiner

PROCESS OF PACKAGING AND MODULAR PACKAGING FACILITY FOR PACKAGING PRODUCTS ON SUPPORTS

TECHNICAL FIELD

The present invention generally to a process of packaging capable of contemporaneously execute multiple packaging cycles and to a modular packaging facility for packaging products on supports. In accordance with an aspect the process and modular packaging facility of the invention execute packaging cycles using supports, such as trays or flat supports, of different types. The process and modular packaging facility of the invention may be used for vacuum skin packaging (VSP) of products or for the packaging of products under a modified atmosphere (MAP) or even for the fluid tight closure of products between a support and a covering film.

BACKGROUND ART

Vacuum packaging is a well-known process for packaging a wide variety of products, in particular food products. Among the known vacuum packaging processes, vacuum skin packaging is employed for packaging food products such as fresh and frozen meat and fish, cheese, processed meat, ready meals and the like. Vacuum skin packaging is basically a thermoforming process. In particular, the product is placed on a rigid or semi-rigid support (such as a tray, a bowl, a plate, or a cup). The support with the product placed thereon is put in a vacuum chamber, where a film of thermoplastic material, held above the product placed on the support, is heated and softened.

It is also known to package products under a controlled or modified atmosphere: in this case, before tightly fixing a plastic film to the respective product loaded support, natural atmosphere is evacuated from the space between the support and the plastic film and then the space between the support and the film is injected with gas at a controlled composition.

Sophisticated apparatus and processes have been conceived and developed in order to automatically convey a plurality of supports into a packaging station where a plastic film portion is attached to the product loaded supports, thereby efficiently and quickly obtaining a number of packaged products. For instance, known apparatus and processes are disclosed in WO2009141214, WO2014060507 and WO2014166940. Although the solutions disclosed in these publications allow to efficiently form high quality packaged products, and permit high productivity, these results are obtained at the price of certain limitations.

As a first point, certain of the apparatus disclosed in the above publications present a complex structure and a non-negligible size, thus requiring high capital investments and always the availability of big spaces for their installation.

Moreover, sophisticated machines with a high degree of automation may be sensitive to the reliability of many components: the malfunction of a small subpart or of a component may require machine stop and service by highly qualified technical personnel.

Furthermore, big size fully automated packaging machines are often scarcely flexible in the sense that they may not be easily adapted to small production batches, let alone to packaging of products on supports of different geometries.

It is therefore an object of the present invention to provide a packaging process and a packaging facility capable of adequately solving the above problems.

Additionally, it is an object of the present invention offering a packaging process and a packaging facility which are conceived such as to be easily adaptable to big and small productions. Furthermore, another object of the invention if a process and a facility which although requiring human intervention are suitable to optimize human and machine times such as to deliver packages at reasonable production rates.

Not last, it is an object of the invention providing a packaging process and a packaging facility which may be implemented without huge investments.

Furthermore, it is an auxiliary object of the invention offering a packaging process and a packaging facility suitable for making packages using supports of different geometries/sizes.

Moreover, it is an auxiliary object providing a process and a facility which are capable of efficiently remove air and/or create a controlled atmosphere with a wide variety of trays or supports.

Another auxiliary object is an apparatus capable of operating in a safe manner.

SUMMARY

At least one of the above objects is substantially reached by process according to one or more of the appended claims.

One or more of the above objects are also reached by a packaging facility according to the appended claims.

BRIEF DESCRIPTION OF THE DRAWINGS

Aspects of the present invention are disclosed in the following detailed description, which is provided by way of example and should not be read in a limitative manner. The description makes reference to the accompanying drawings, wherein.

DEFINITIONS

The Supports

Figure 1:
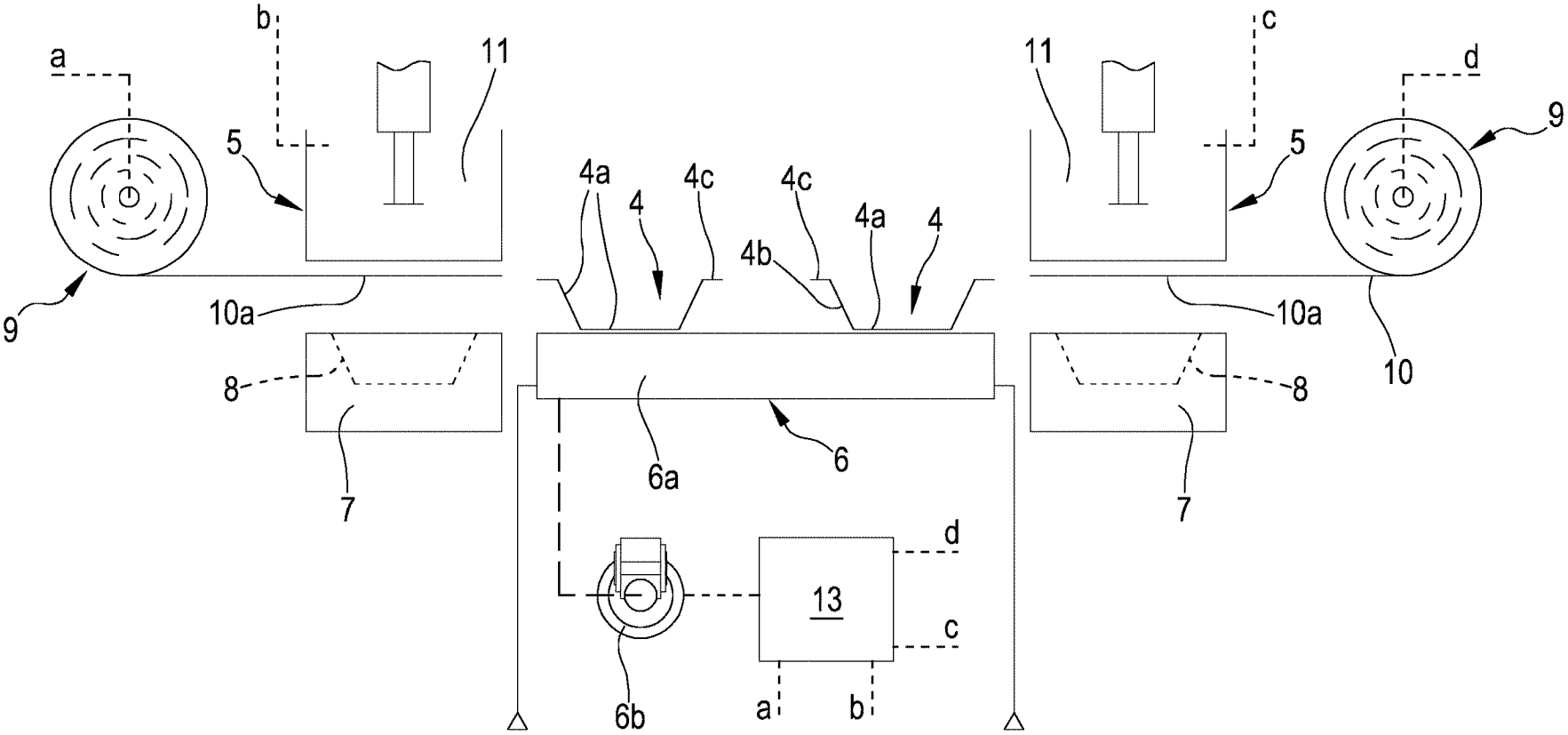
FIG. 1 is a front view of a first embodiment of a packaging facility according to certain aspects of the invention.

As used herein support means a flat or substantially flat support or a container 4 (or tray) of the type having a base wall 4*a*, a side wall 4*b* and optionally a top flange 4*c* radially emerging from the side wall 4*b*; the support or tray 4 may be made either in plastic material or in cardboard or in one or more cardboard layers combined with one or more plastic layers.

The tray or supports 4 may have a polygonal, e.g., rectangular, shape (when seen from above) or any other suitable shape, such as round, square, elliptical and other.

Trays or supports with a side wall may for example be manufactured by thermoforming or injection molding. Tray or supports of flat conformation may be extruded, co-extruded, laminated and then the cut to size.

The trays or supports described and claimed herein are preferably, although not limitatively, made of a single layer or of a multi-layer polymeric material.

In case of a single layer material suitable polymers are for instance polystyrene, polypropylene, polyesters, high density polyethylene, poly(lactic acid), PVC and the like, either foamed or solid.

Preferably the tray or support is provided with gas barrier properties. As used herein such term refers to a film or sheet of material which has an oxygen transmission rate of less than 200 $cm^3/m^2$-day-bar, less than 150 $cm^3/m^2$-day-bar, less than 100 $cm^3/m^2$-day-bar as measured according to ASTM D-3985 at 23° C. and 0% relative humidity.

Suitable materials for gas barrier monolayer thermoplastic trays 4 are for instance polyesters, polyamides and the like.

If the tray or support is made of a multi-layer polymeric material, suitable polymers are for instance ethylene homo- and co-polymers, propylene homo- and co-polymers, polyamides, polystyrene, polyesters, poly(lactic acid), PVC and the like. Part of the multi-layer material can be solid and part can be foamed.

For example, the tray or support may comprises at least one layer of a foamed polymeric material chosen from the group consisting of polystyrene, polypropylene, polyesters and the like.

The multi-layer material may be produced either by co-extrusion of all the layers using co-extrusion techniques or by glue- or heat-lamination of, for instance, a rigid foamed or solid substrate with a thin film, usually called "liner".

The thin film may be laminated either on the side of the tray or support 4 in contact with the product P or on the side facing away from the product P or on both sides. In the latter case the films laminated on the two sides of the tray or support may be the same or different. A layer of an oxygen barrier material, for instance (ethylene-co-vinyl alcohol) copolymer, is optionally present to increase the shelf-life of the packaged product P.

Gas barrier polymers that may be employed for the gas barrier layer are PVDC, EVOH, polyamides, polyesters and blends thereof. The thickness of the gas barrier layer will be set in order to provide the tray with an oxygen transmission rate suitable for the specific packaged product.

The tray or support may also comprise a heat sealable layer. Generally, the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate.

Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer material used to form the tray or support, part of this structure may be foamed and part may be un-foamed. For instance, the tray or support may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

The tray or support may be obtained from a sheet of foamed polymeric material having a film comprising at least one oxygen barrier layer and at least one surface sealing layer laminated onto the side facing the packaged product, so that the surface sealing layer of the film is the food contact layer the tray. A second film, either barrier or non-barrier, may be laminated on the outer surface of the tray.

Specific tray or support formulations are used for food products which require heating in conventional or microwave oven before consumption. The surface of the container in contact with the product, i.e. the surface involved in the formation of the seal with the lidding film, comprises a polyester resin. For instance the container can be made of a cardboard coated with a polyester or it can be integrally made of a polyester resin. Examples of suitable containers for the package of the invention are CPET, APET or APET/CPET containers. Such container can be either foamed or not-foamed.

Trays or supports containing foamed parts, have a total thickness lower than 8 mm, and for instance may be comprised between 0.5 mm and 7.0 mm and more frequently between 1.0 mm and 6.0 mm.

In case of rigid tray not containing foamed parts, the total thickness of the single-layer or multi-layer thermoplastic material is preferably lower than 2 mm, and for instance may be comprised between 0.1 mm and 1.2 mm and more frequently between 0.2 mm and 1.0 mm.

Geometric Property of the Supports

In the present description and in the attached claims it is indicated that supports may differ in at least one geometric property. In detail, the geometric property may be one of: the height, or the width, or the length, or the wall thickness, or the overall size, or the shape of the support base, or the shape of the top flange (if present), or the shape of the side wall (if present), or the overall shape. In other words, when the description or the claims indicate that supports differ from one another in at least one geometric property, then the supports may differ in shape (e.g., some may have a circular base, some other a squared base, and some other a rectangular base), or they may differ in size (e.g., present different height and/or width and/or length), etcetera.

The Film or Film Material

The film or film material described herein may be applied to the support to form a lid (e.g. for MAP—modified atmosphere packaging) or it may be applied to the support and product to form a skin-like cover in contact with the support surface and product, and matching the contour of the product (VSP—vacuum skin packaging).

The film for skin applications may be made of a flexible multi-layer material comprising at least a first outer heat-sealable layer, an optional gas barrier layer and a second outer heat-resistant layer. The outer heat-sealable layer may comprise a polymer capable of welding to the inner surface of the supports carrying the products to be packaged, such as for instance ethylene homo- or co-polymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional gas barrier layer preferably comprises oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or co-polymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters. In all the film layers, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents and the like additives known to those skilled in the art of packaging films.

One or more layers of the film can be cross-linked to improve the strength of the film and/or its heat resistance. Cross-linking may be achieved by using chemical additives or by subjecting the film layers to an energetic radiation treatment. The films for skin packaging are typically manufactured in order to show low shrink when heated during the packaging cycle. Those films usually shrink less than 15% at 160° C., more frequently lower than 10%, even more frequently lower than 8% in both the longitudinal and transversal direction (ASTM D2732). The films usually have a thickness comprised between 20 microns and 200 microns, more frequently between 40 and 180 microns and even more frequently between 50 microns and 150 microns.

On the other hand, in case the film 10*a* is used for creating a lid on the tray 4, the film material may be obtained by co-extrusion or lamination processes. Lid films may have a symmetrical or asymmetrical structure and can be of a single layer or multilayer type.

The multilayer films have at least 2, more frequently at least 5, and even more frequently at least 7 layers.

The total thickness of the film may vary from 3 to 100 micron, more frequently from 5 to 50 micron, even more frequently from 10 to 30 micron. The films may optionally be cross-linked. Cross-linking may be carried out by irradiation with high energy electrons at a suitable dosage level as known in the art. The lid films described above may be heat shrinkable or heat-set. The heat shrinkable films typically show a free shrink value measured at 120° C. according to ASTM D2732 in the range of from 2 to 80%, more frequently from 5 to 60%, even more frequently from 10 to 40% in both the longitudinal and the transverse direction. The heat-set films usually have free shrink values lower than 10% at 120° C., preferably lower than 5% in both the longitudinal and transversal direction (ASTM D 2732).

Lid films usually comprise at least a heat sealable layer and an outer skin layer, which is generally made up of heat resistant polymers or polyolefin. The sealing layer typically comprises a heat-sealable polyolefin which in turn comprises a single polyolefin or a blend of two or more polyolefins such as polyethylene or polypropylene or a blend thereof. The sealing layer can be further provided with anti-fogging properties by incorporating one or more anti-fogging additives into its composition or by coating or spraying one or more anti-fogging additives onto the surface of the sealing layer by technical means known in the art.

The sealing layer may further comprise one or more plasticizers. The skin layer may comprises polyesters, polyamides or polyolefin. In some structures, a blend of polyamide and polyester can advantageously be used for the skin layer. In some cases, the lid films comprise a barrier layer. Barrier films typically have an OTR (evaluated at 23° C. and 0% R.H. according to ASTM D-3985) below 100 $cm^3/(m^2 \cdot day \cdot atm)$ and more frequently below 80 $cm^3/(m^2 \cdot day \cdot atm)$. The barrier layer is usually made of a thermoplastic resin selected among a saponified or hydrolyzed product of ethylene-vinyl acetate copolymer (EVOH), an amorphous polyamide and a vinyl-vinylidene chloride and their admixtures. Some materials comprise an EVOH barrier layer, sandwiched between two polyamide layers. The skin layer typically comprises polyesters, polyamides or polyolefin.

In some packaging applications, the lid films do not comprise any barrier layer. Such films usually comprise one or more polyolefin herein defined. Non-barrier films typically have an OTR (evaluated at 23° C. and 0% R.H. according to ASTM D-3985) from 100 $cm^3/(m^2 \cdot day \cdot atm)$ up to 10000 $cm^3/(m^2 \cdot day \cdot atm)$, more typically up to 6000 $cm^3/(m^2 \cdot day \cdot atm)$.

Peculiar polyester-based compositions are those used for tray lidding of ready-to-eat meal packages. For these films, the polyester resins can make up at least 50%, 60%, 70%, 80%, or 90% by weight of the film. These films are typically used in combination with polyester-based supports.

For example, the container can be made of a cardboard coated with a polyester resin or it can be integrally made of a polyester resin. Examples of suitable containers for the package are CPET, APET or APET/CPET containers, either foamed or not foamed.

Usually, biaxially oriented PET is used as the lid film due to its high thermal stability at standard food heating/cooking temperatures. Often biaxially oriented polyester films are heat-set, i.e. non-heat-shrinkable. To improve the heat-seal-ability of the PET lidding film to the container a heat-sealable layer of a material with a lower melting point is usually provided on the film. The heat-sealable layer may be coextruded with the PET base layer (as disclosed in EP-A-1529797 and WO2007/093495) or it may be solvent- or extrusion-coated over the base film (as disclosed in U.S. Pat. No. 2,762,720 and EP-A-1252008).

Particularly in the case of fresh meat packages, twin lidding film comprising an inner, oxygen-permeable, and an outer, oxygen-impermeable, lidding film are advantageously used. The combination of these two films significantly prevents the meat discoloration also when the packaged meat extends upwardly with respect to the height of the tray walls, which is the most critical situation in barrier packaging of fresh meat. These films are described for example in EP1848635 and EP0690012, the disclosures of which are incorporated herein by reference. In some examples, twin lidding film can be made by sealing two suitable films in the region of the corners by means of very small bonding or sealing points. In this manner, the twin lidding film can be handled more easily in the different stages of the packaging process.

The lid film can be monolayer. Typical composition of monolayer films comprise polyesters as herein defined and their blends, or polyolefins as herein defined and their blends.

In all the film layers herein described, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents, anti-fog agents or compositions, and the like additives known to those skilled in the art of packaging films.

Definitions and Conventions Concerning Materials

PVDC is any vinylidene chloride copolymers wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term "polyamides" as used herein is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 6I, polyamide 6I/6T, polyamide MXD6, polyamide MXD6/MXDI, and blends thereof.

As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm$^3$. The term linear low density polyethylene (LLDPE) is generally understood to include that group of ethylene/alpha-olefin copolymers which fall into the density range of about 0.915 to about 0.94 g/cm$^3$ and particularly about 0.915 to about 0.925 g/cm$^3$. Sometimes linear polyethylene in the density range from about 0.926 to about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

As used herein, the term "polyolefin" refers to any polymerized olefin, which can be linear, branched, cyclic, aliphatic, aromatic, substituted, or unsubstituted. More specifically, included in the term polyolefin are homo-polymers of olefin, co-polymers of olefin, co-polymers of an olefin and a non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-alpha-olefin co-polymer, propylene-alpha-olefin co-polymer, butene-alpha-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

The term "polyester" is used herein to refer to both homo- and co-polyesters, wherein homo-polyesters are defined as polymers obtained from the condensation of one dicarboxylic acid with one diol and co-polyesters are defined as polymers obtained from the condensation of one or more dicarboxylic acids with one or more diols. Suitable polyester resins are, for instance, polyesters of ethylene glycol and terephthalic acid, i.e. poly(ethylene terephthalate) (PET). Preference is given to polyesters which contain ethylene units and include, based on the dicarboxylate units, at least 90 mol %, more preferably at least 95 mol %, of terephthalate units. The remaining monomer units are selected from other dicarboxylic acids or diols. Suitable other aromatic dicarboxylic acids are preferably isophthalic acid, phthalic acid, 2,5-, 2,6- or 2,7-naphthalenedicarboxylic acid. Of the cycloaliphatic dicarboxylic acids, mention should be made of cyclohexanedicarboxylic acids (in particular cyclohexane-1,4-dicarboxylic acid). Of the aliphatic dicarboxylic acids, the (C3-Ci9)alkanedioic acids are particularly suitable, in particular succinic acid, sebacic acid, adipic acid, azelaic acid, suberic acid or pimelic acid. Suitable diols are, for example aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol, optionally heteroatom-containing diols having one or more rings.

Co-polyester resins derived from one or more dicarboxylic acid(s) or their lower alkyl (up to 14 carbon atoms) diesters with one or more glycol(s), particularly an aliphatic or cycloaliphatic glycol may also be used as the polyester resins for the base film. Suitable dicarboxylic acids include aromatic dicarboxylic acids such as terephthalic acid, isophthalic acid, phthalic acid, or 2,5-, 2,6- or 2,7-naphthalenedicarboxylic acid, and aliphatic dicarboxylic acids such as succinic acid, sebacic acid, adipic acid, azelaic acid, suberic acid or pimelic acid. Suitable glycol(s) include aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol. Examples of such copolyesters are (i) copolyesters of azelaic acid and terephthalic acid with an aliphatic glycol, preferably ethylene glycol; (ii) copolyesters of adipic acid and terephthalic acid with an aliphatic glycol, preferably ethylene glycol; and (iii) copolyesters of sebacic acid and terephthalic acid with an aliphatic glycol, preferably butylene glycol; (iv) co-polyesters of ethylene glycol, terephthalic acid and isophthalic acid. Suitable amorphous co-polyesters are those derived from an aliphatic diol and a cycloaliphatic diol with one or more, dicarboxylic acid(s), preferably an aromatic dicarboxylic acid. Typical amorphous copolyesters include co-polyesters of terephthalic acid with an aliphatic diol and a cycloaliphatic diol, especially ethylene glycol and 1,4-cyclohexanedimethanol.

DETAILED DESCRIPTION

It should be noted that in the present detailed description corresponding parts shown in the various Figures are indicated with the same reference numeral through the Figures. Note that items represented in the Figures may not be in scale.

FIGS. 1-4 show a modular packaging facility 1 according to a first embodiment of the invention. The modular packaging facility 1 is configured for executing a packaging process using multiple independent packaging units 5 each designed to effect an own independent packaging cycle.

Figure 2:
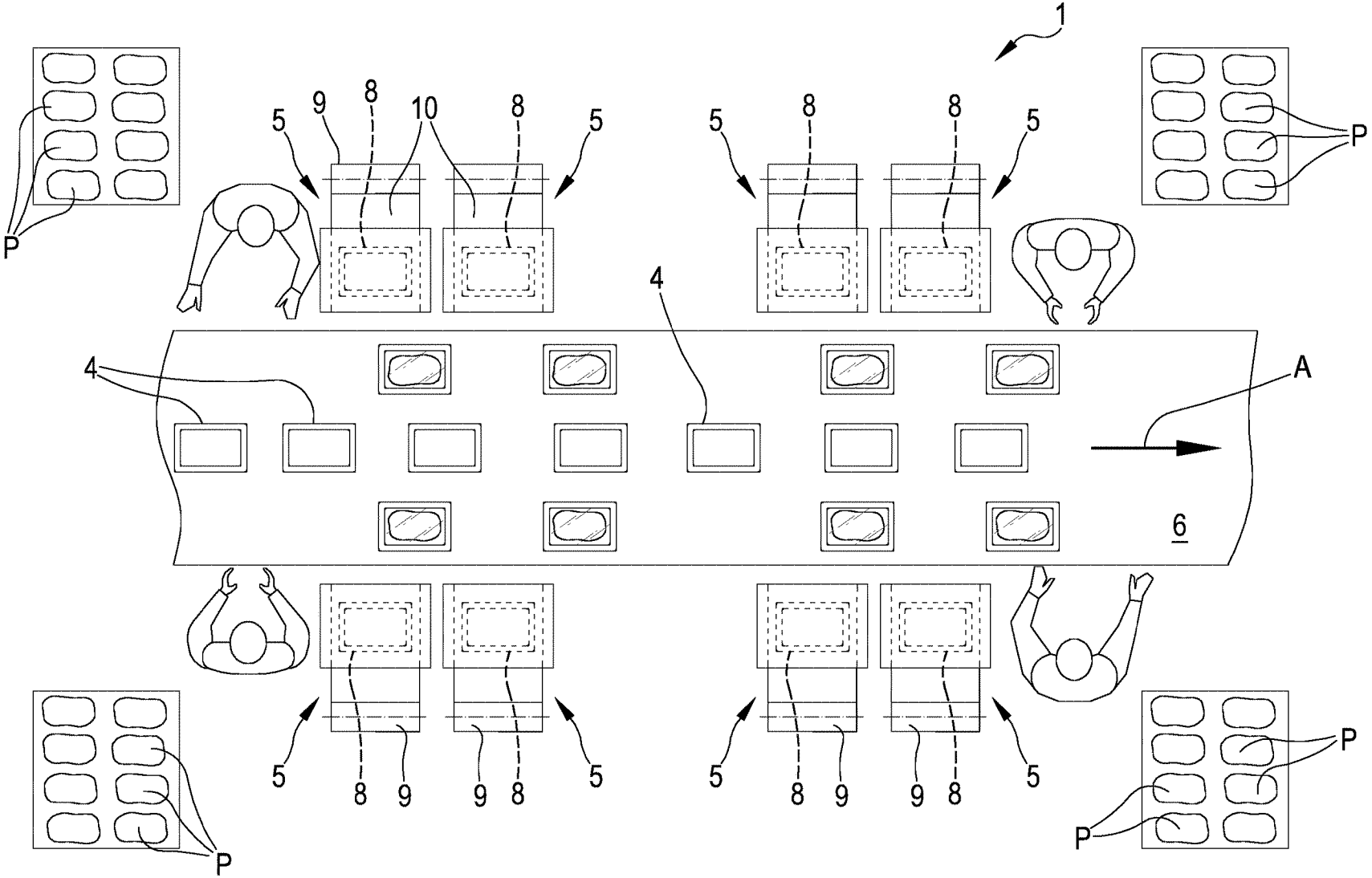
FIGS. 2-4 are top views of different embodiments of the packaging facility of FIG. 1.
Figure 2A:
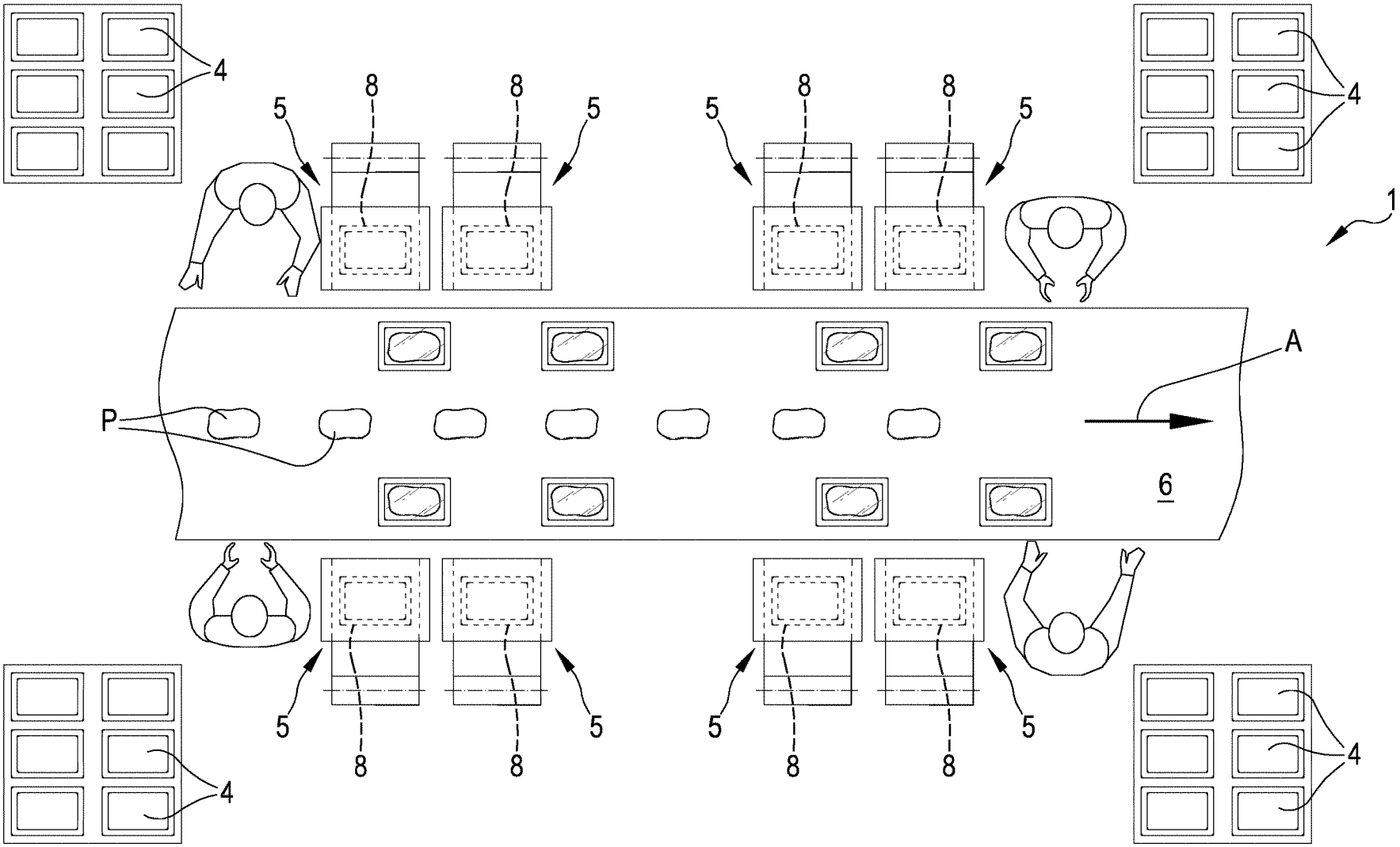
Figure 3:
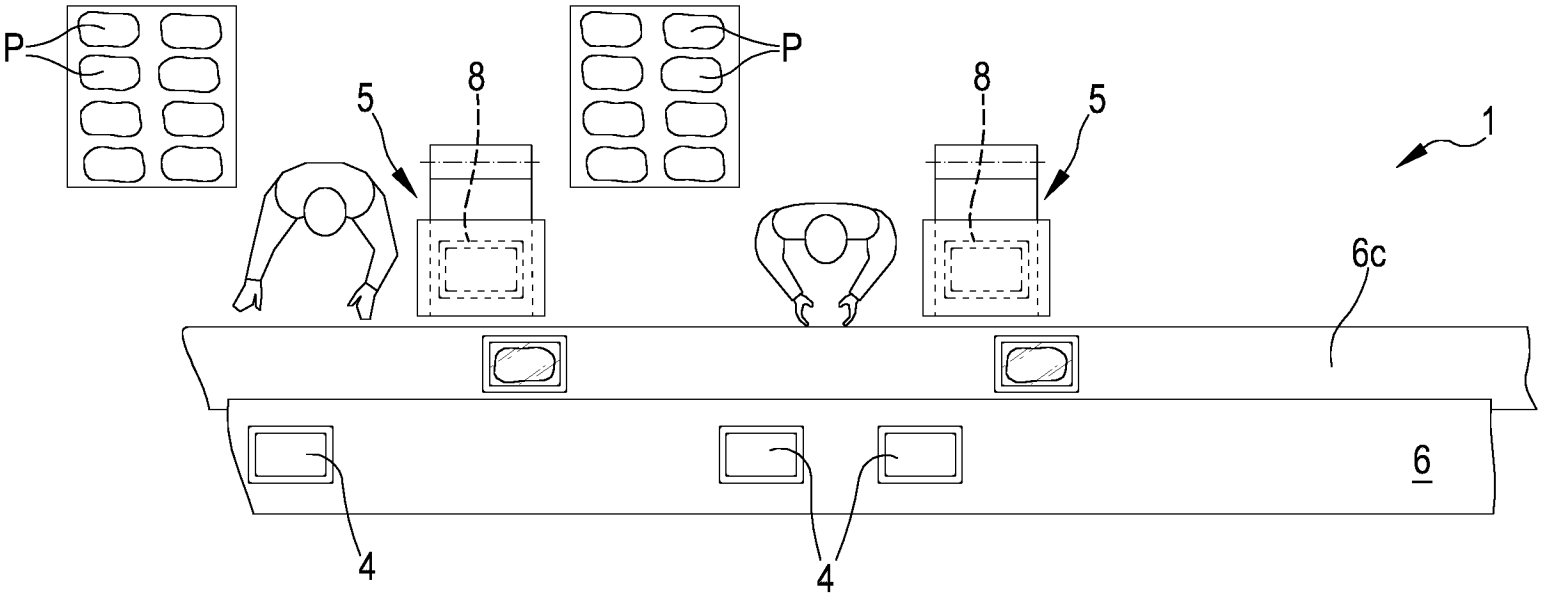
Figure 4:
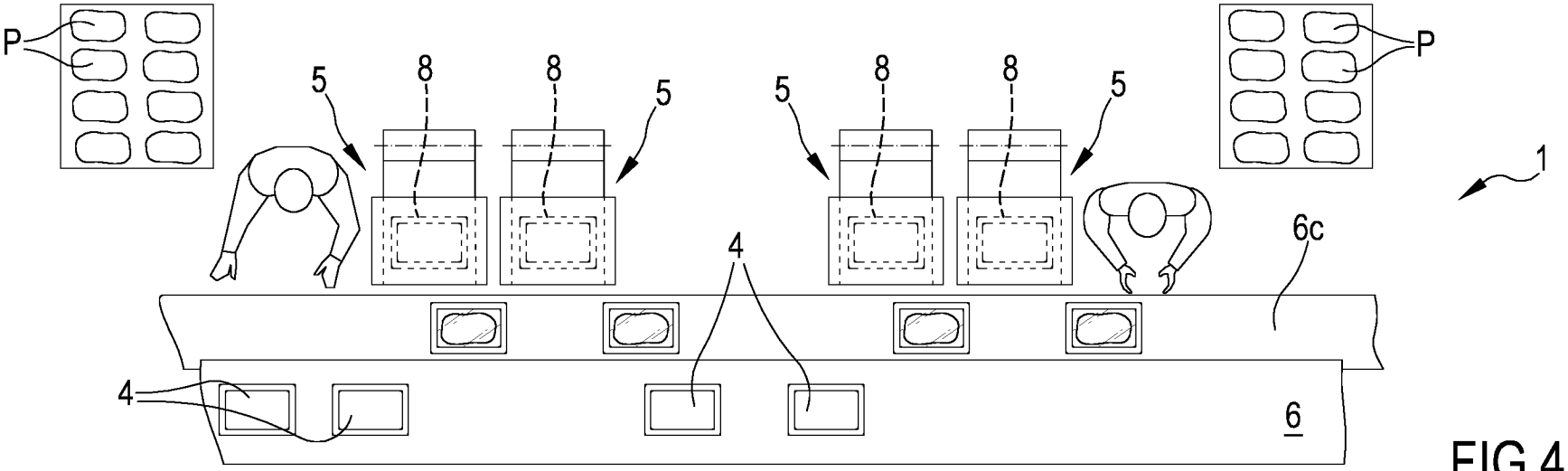

In fact, the packaging facility 1 comprises a plurality of independent packaging units 5 each configured to receive one or more product P loaded supports. The facility 1 also includes at least one feed line 6 extending along a prefixed feed path and serving the plurality of packaging units 5, which are positioned along the feed line 6. For example, the feed line may include at least one conveyor 6*a* for displacing the products P, or supports 4, or the product loaded supports, along the feed path. In an alternative, the supports 4 may be stacked next to each packaging unit 5 (see FIG. 2A) instead of being transported by the conveyor 6*a*, which may therefore be used for transportation of the products P. The conveyor 6*a* or the conveyors are driven by a motor 6*b* (FIG. 1), preferably an electric motor, under the control of an own control unit 13 active on the motor or under the control of a control unit part of the infrastructure control system. This control unit 13 is programmed or configured to control the conveyor 6*a* to move either in a step by step manner or at a predetermined constant speed, such that the products P or the supports 4 or the product loaded supports be displaced along the feed path at a regular pace. Note that it may be envisaged that the infrastructure comprises a discharge path 6*c*, also including one or more conveyors, and adapted to receive the packaged products once extracted from the respective unit 5 at the end of the packaging cycle (see FIGS. 3 and 4).

Figure 5:
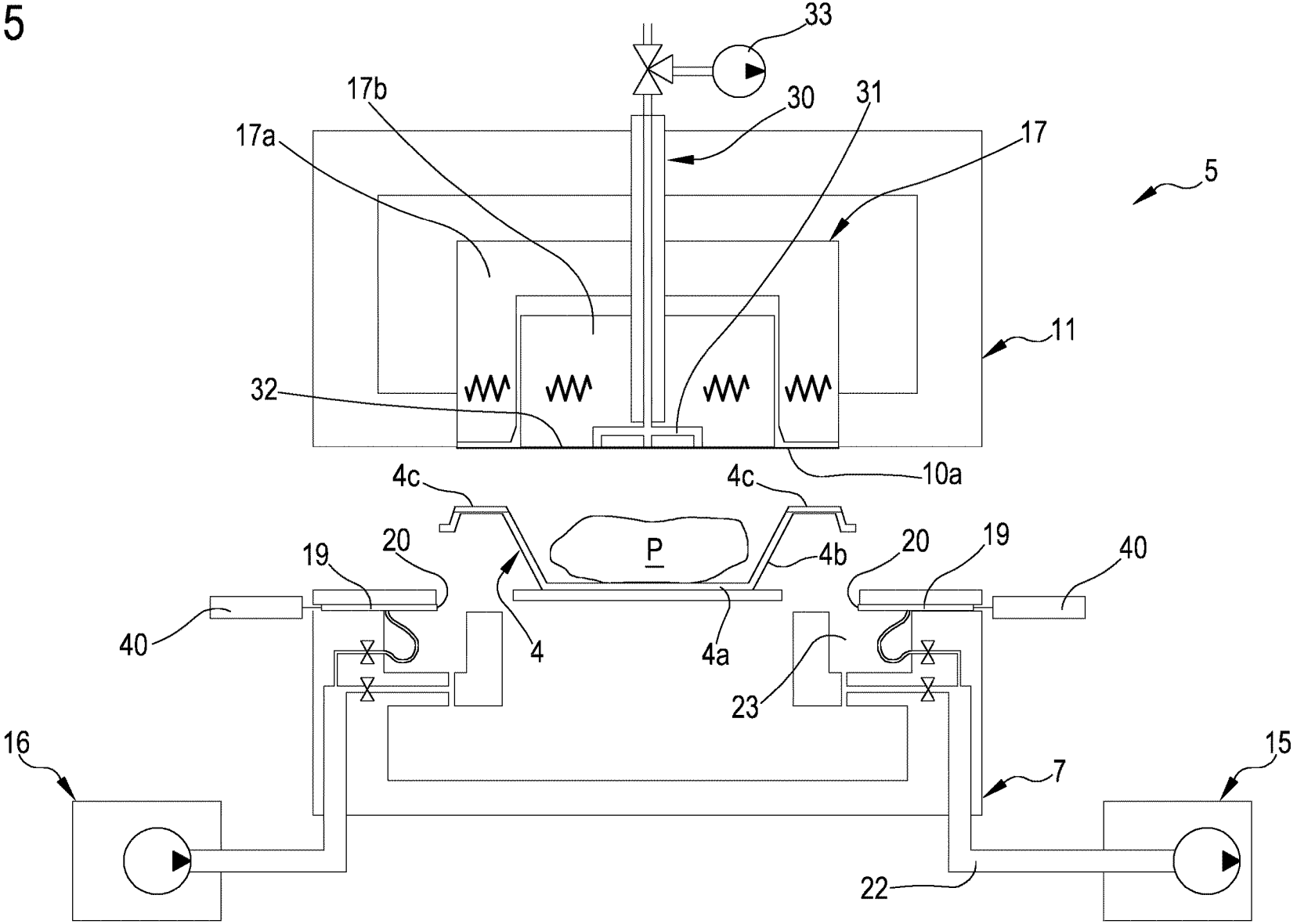
FIGS. 5-9 show a possible structure of a packaging unit of the facility of FIGS. 1-4 during various phases of a packaging process.
Figure 7:
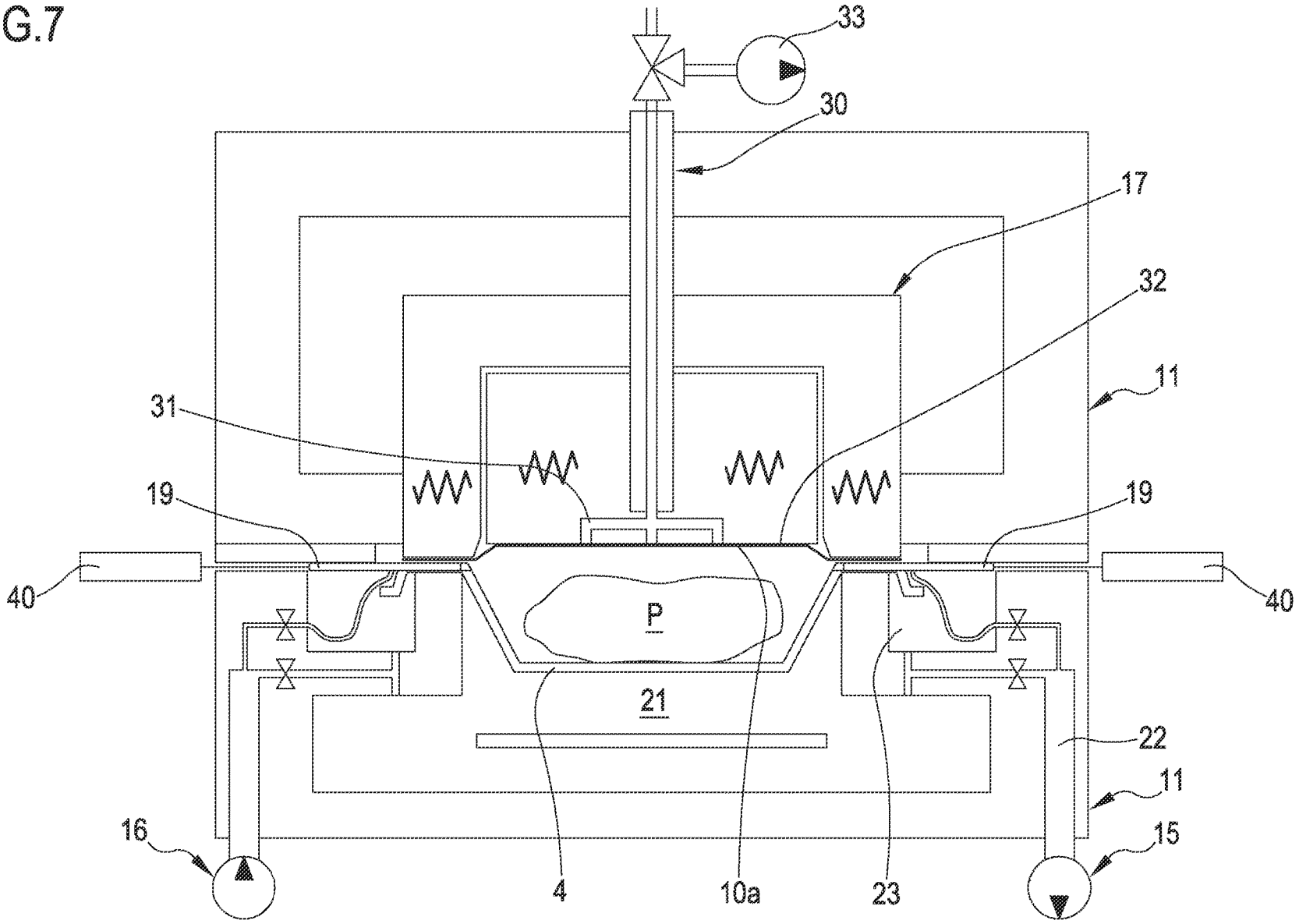

Going in further detail, each one of the packaging units 5 has a lower tool 7 configured to define one or more seats 8 for receiving the one or more product loaded supports. In the example shown in the figures, each lower tool 7 defines two adjacent seats 8 each for receiving a respective support 4 such as to be able to make two packages per packaging cycle. Each unit also has a film supply 9, which in the example shown includes at least a roll of plastic film, configured for supplying a film 10 to be applied to the product loaded supports hosted in the seat(s) of the lower tool. Furthermore, each one of the packaging units 5 includes an upper tool 11 cooperating with the lower tool 7. In greater detail, the upper tool 11 and the lower tool 7 are relatively movable the one with respect to the other (for example under the action of one or more actuators) between at least a first position (see FIG. 5), where the two tools are spaced from one another such as to allow access of the product loaded supports into the seats 8 of the lower tools 7 and positioning of at least one portion 10*a* of the plastic film 10 above the lower tool 7, and a second position (see FIGS. 7, 8, 10, 13, and 18), allowing coupling of the film portion(s) 10*a* to the respective support(s) 4. Once the upper and lower tool are in the second position, they define a closed chamber 21 (FIG. 7), preferably a fluid tight closed chamber, which communicates with the arrangements necessary to create a vacuum or to create a controlled atmosphere inside the same chamber. When the chamber is closed the actual packaging cycle takes place as explained herein below. Each one of the packaging units 5 is also provided with a vacuum arrangement 15 (see FIGS. 11 and 12) configured for removing gas from a volume between each support received by the lower tool 7 and the respective film portion 10*a*, which is located above the same product loaded support. In a variant, each one of the packaging unit comprises the vacuum arrangement 15 and also a controlled atmosphere arrangement 16 (see FIGS. 5, 6, 7, 8, and 9) configured to inject a controlled gas composition in said volume in order to create packages which are tightly closed maintaining inside the package a gas composition which is different from the natural atmospheric composition at sea level.

Moreover, upper tool 11 of each distinct packaging unit 5 is provided with a heater 17 and is configured for holding at least one film portion 10*a* above the respective product loaded support hosted in the lower tool: in practice the heater 17 may be in the form of any known heating means such as a heated fluid or a resistance or an irradiating element and the holding ability may be provided by mechanical holder or by pneumatic holders 30 (for instance a set of suction holes 31 distributed on an active surface 32 of the upper tool 11 and connected to a suitable vacuum source 33). Thus, the upper tool 11 has the task to receive the film portion 10*a* from the film supply 9 and to keep is just above the respective seat in the lower tool 7, also providing for the heating necessary to bring the film portion to the temperature required for the specific cycle and for the heat bonding of the film portion to the respective support. The heater 17 of each one of the independent packaging units 5 may comprise a single heating platen 17*a*, optionally a flat or a dome shaped heating platen, or it may comprise a peripheral bar 17*a* and a central heating element 17*b* provided with respective heating means and with ability to move relative to each other such that a peripheral band of the film portion 10*a* may be heated by the heating bar 17*a* to a first temperature ideal for heat bonding while the central zone of the film portion may be brought by the central heating element 17*b* to a second temperature (typically lower than the first temperature) for instance ideal for thermal shrink of the plastic film.

Figure 13:
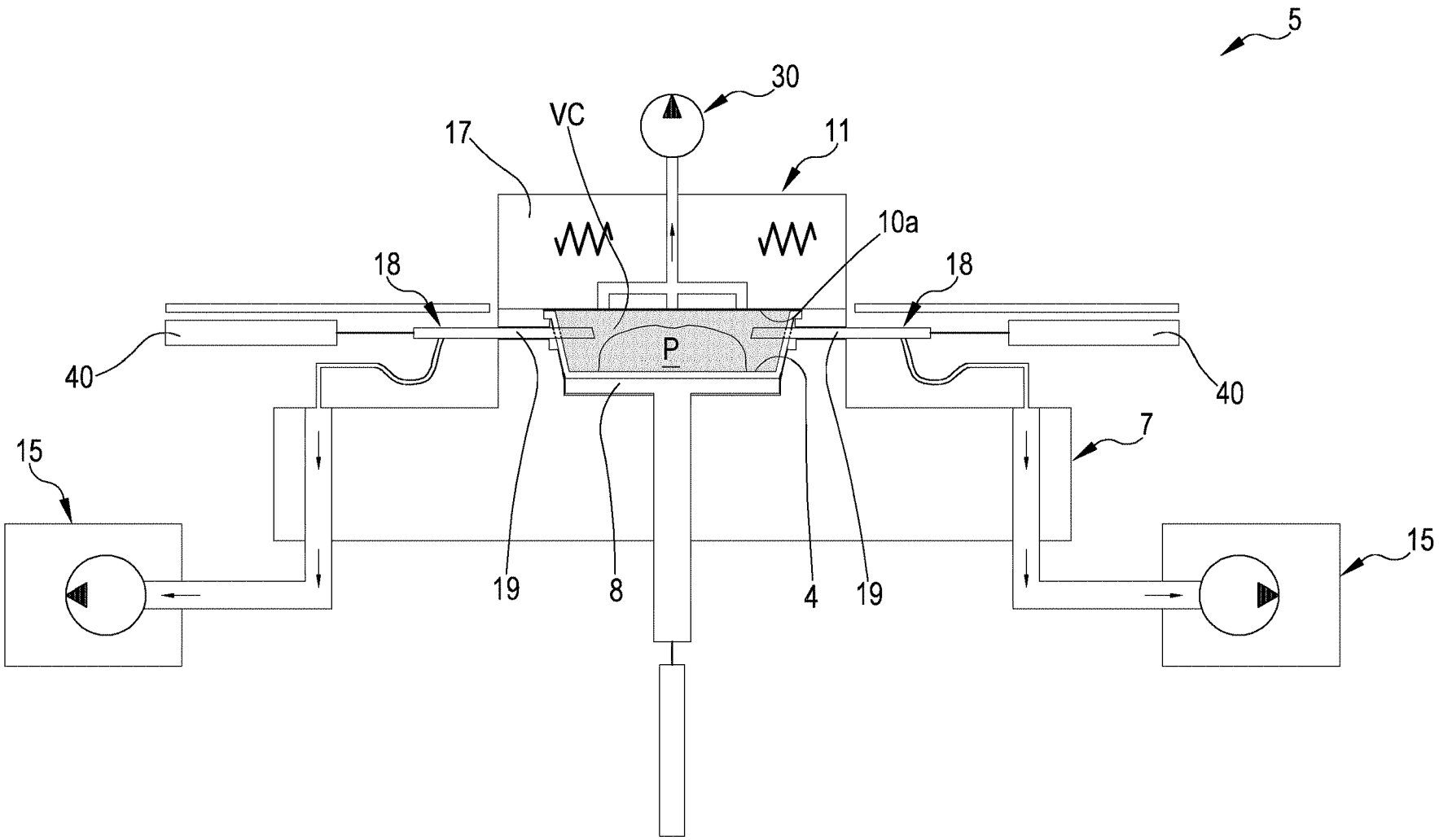
FIGS. 13-15 show a further possible structure of a packaging unit of the facility of FIG. 1-4 during various phases of a packaging cycle.

Each packaging unit 5 of the first embodiment comprises at least one own perforating tool 18, optionally associated with the respective lower tool 7 of each packaging unit 5, and configured to form one or more through holes 4*d* in each support 4 received in said lower tool 7. In practice, the perforating tool 18 may be operated by a respective actuator 40 at least between a rest position (see FIGS. 14 and 15) which allows to position the supports 4 in the respective seat 8 (with the upper and lower tools in the first position) and an operative position where the perforating tool 18 actually perforates one of the walls of the support 4 (FIG. 13). In accordance with a currently preferred option the perforating tool 18 has a properly shaped tip capable of forming in the support wall a hole with a corresponding flap portion which remains attached to the wall of the support 4, as shown in FIGS. 16A and 16C.

In practice, in the first embodiment of the invention each seat 8 of each lower tool 7 of the packaging units 5, has at least one and preferably a plurality of perforating tools 18 creating one of more holes with respective closure flaps in the support wall 4*b*.

Figure 6:
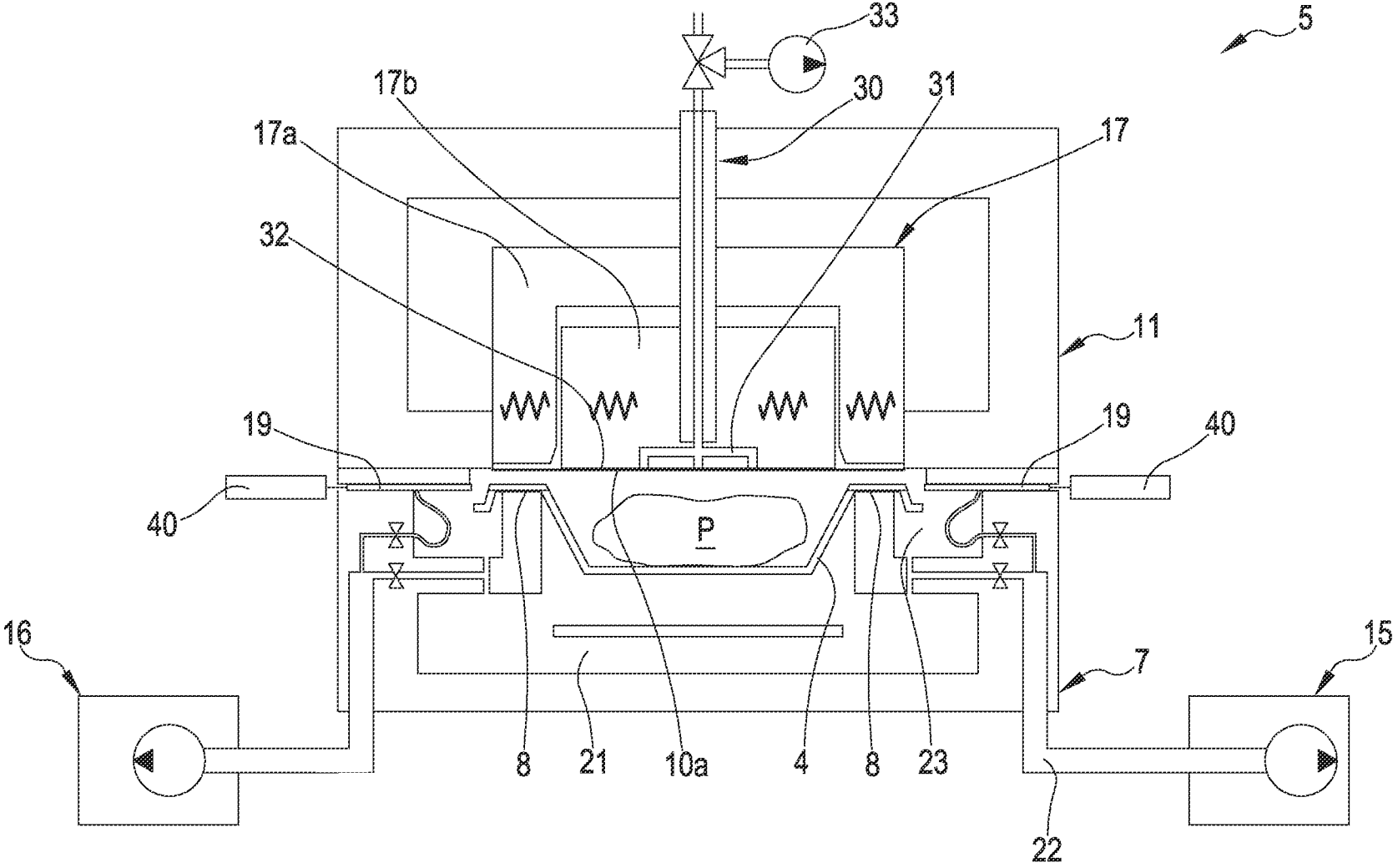
Figure 6A:
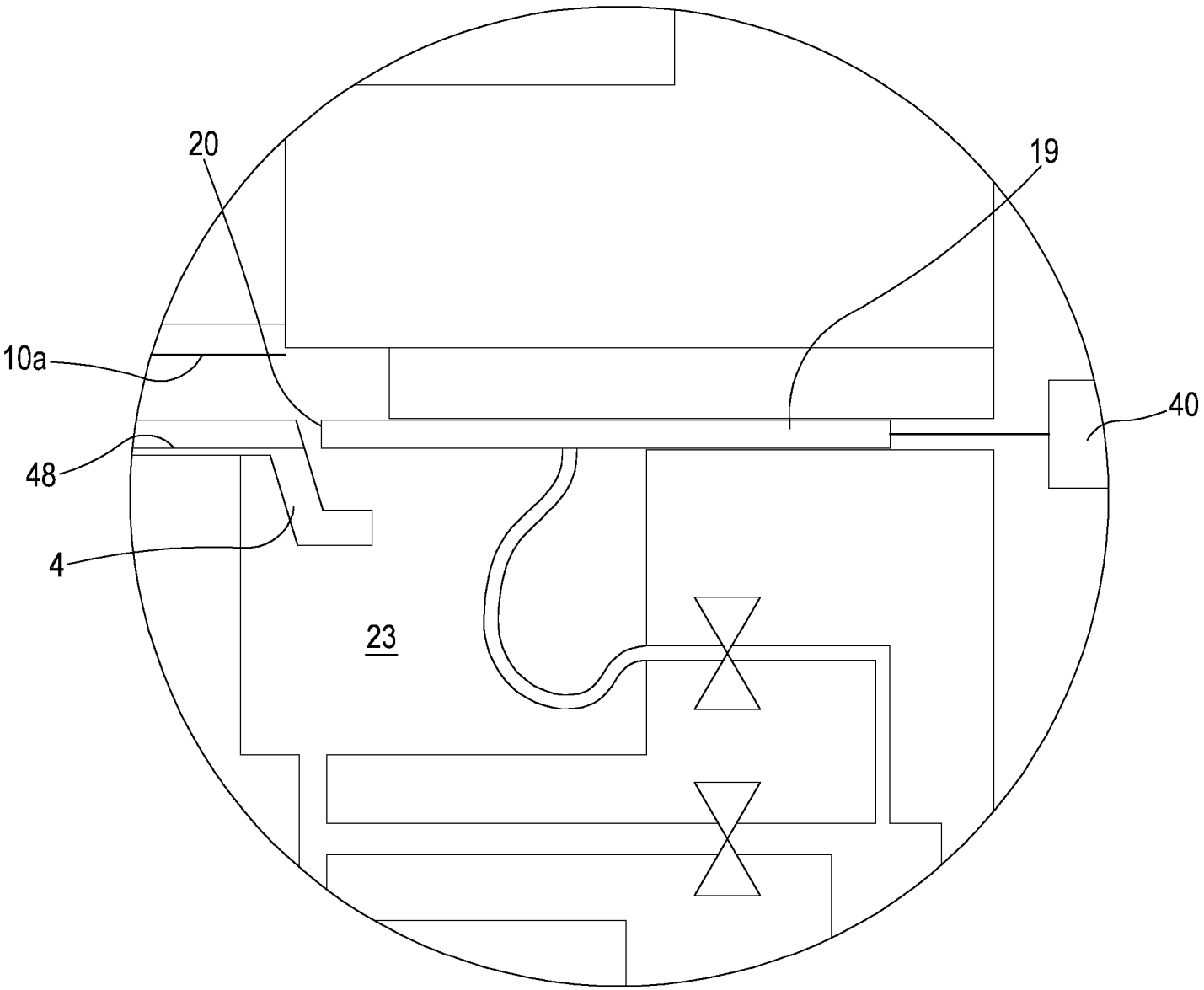
FIG. 6A is an enlarged view showing a detail of FIGS. 5 and 6 relating to a perforating unit and/or a nozzle during a first operative condition in which said perforating unit and/or nozzle is spaced from a support.
Figure 8:
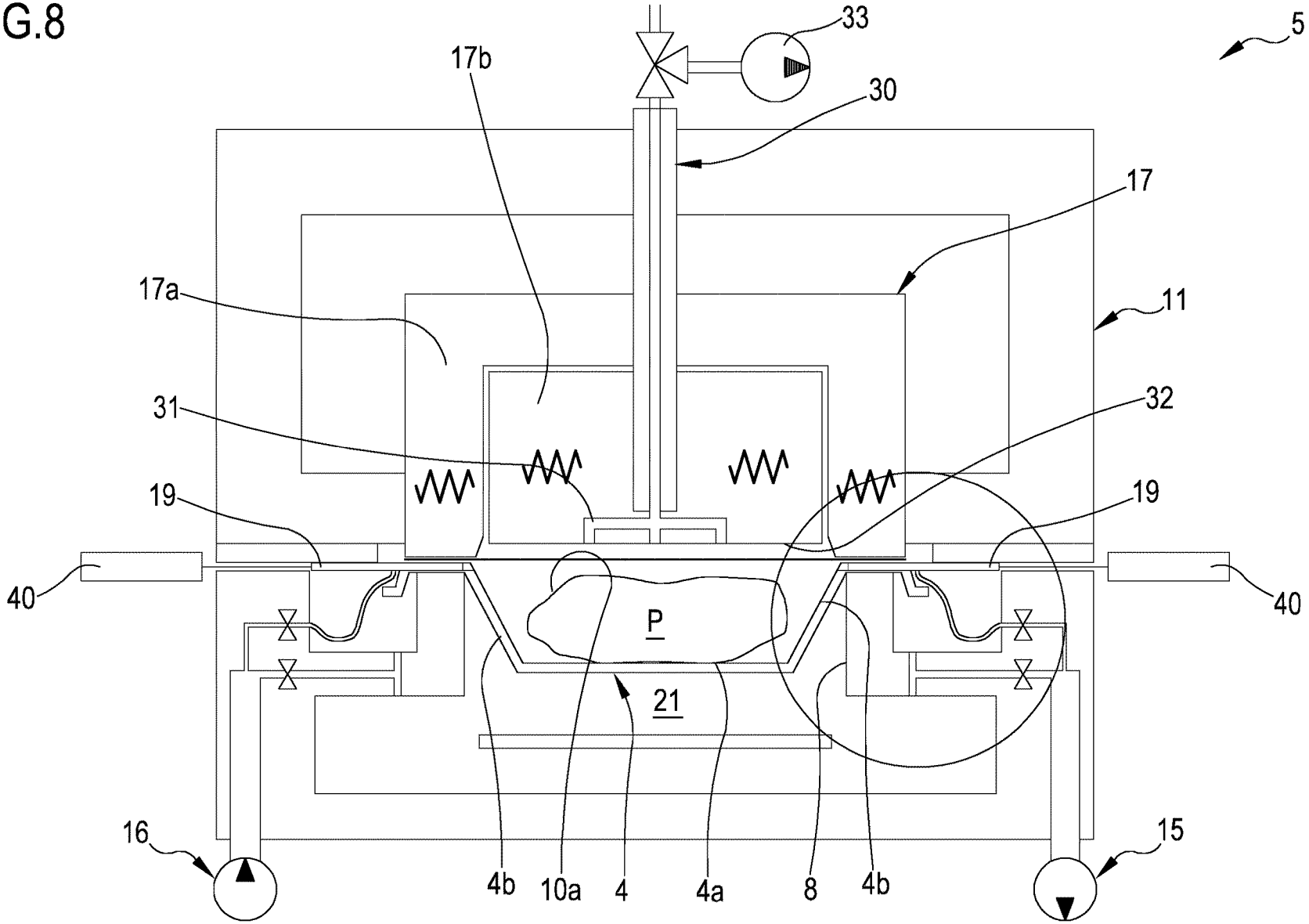
Figure 8A:
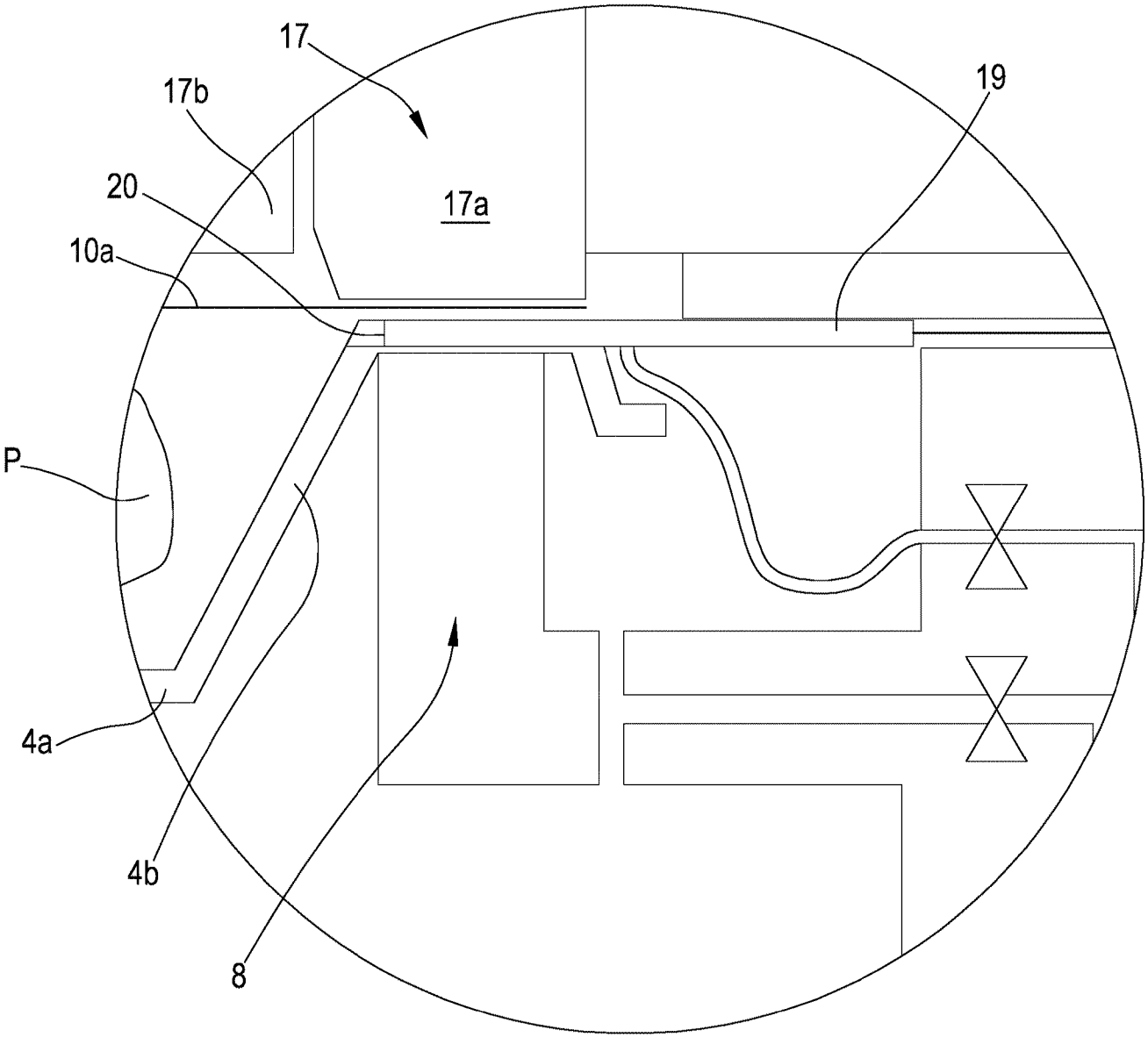
FIG. 8A is an enlarged view showing a detail of FIG. 8 relating to a perforating unit and/or a nozzle during a second operative condition in which said perforating unit and/or nozzle is at the support.
Figure 9:
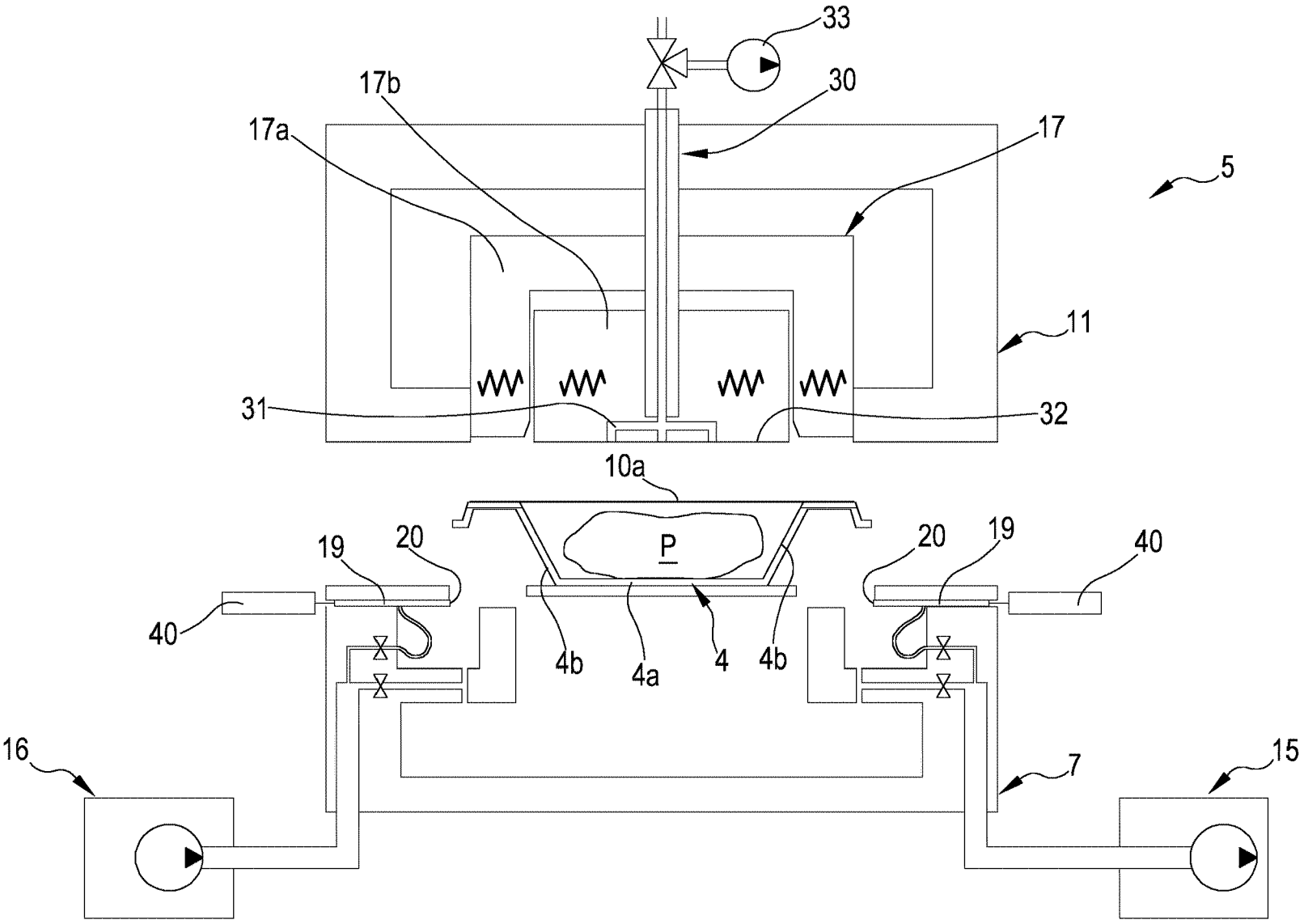
Figure 10:
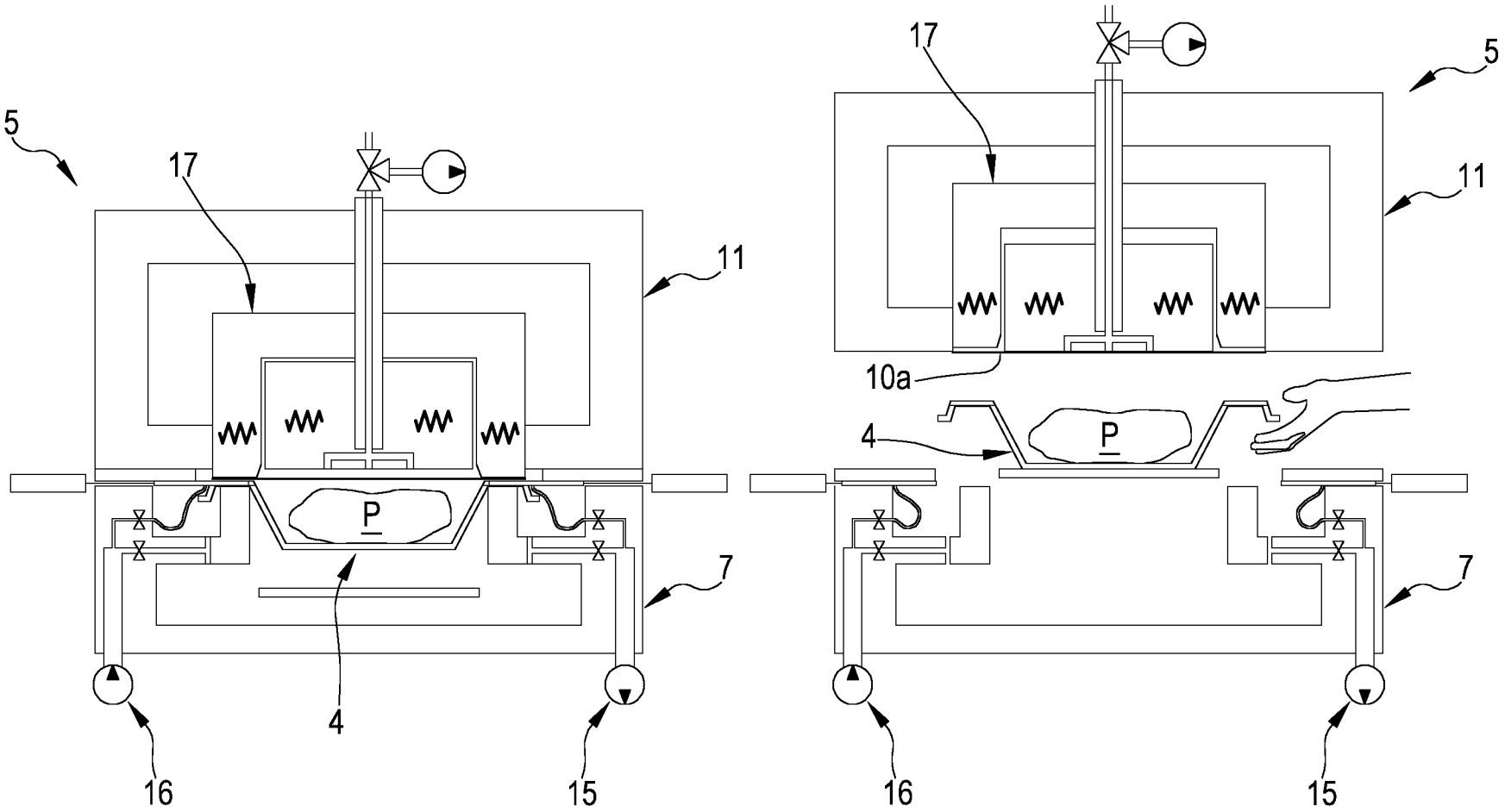
FIG. 10 is a schematic view of two adjacent packaging units during different phases of a packaging cycle.

As an alternative to the perforation tool 18 (or in combination with the use of one or more perforating tools) each one of the plurality of distinct packaging units 5 may comprise at least one nozzle 19 configured to be positioned in an interspace between an upper surface 4*f* of the support and a bottom surface of the film portion 10*a*. Also the nozzle 19 may be operated by a respective actuator 40 at least between a rest position (see FIG. 6A) which allows to position the supports in the respective seat (with the upper and lower tools in the first position) and an operative position (see FIG. 8A) where the nozzle terminal portion is located between the upper surface of the periphery of the respective support and a lower surface of the peripheral region of the respective portion of plastic film.

Figure 14:
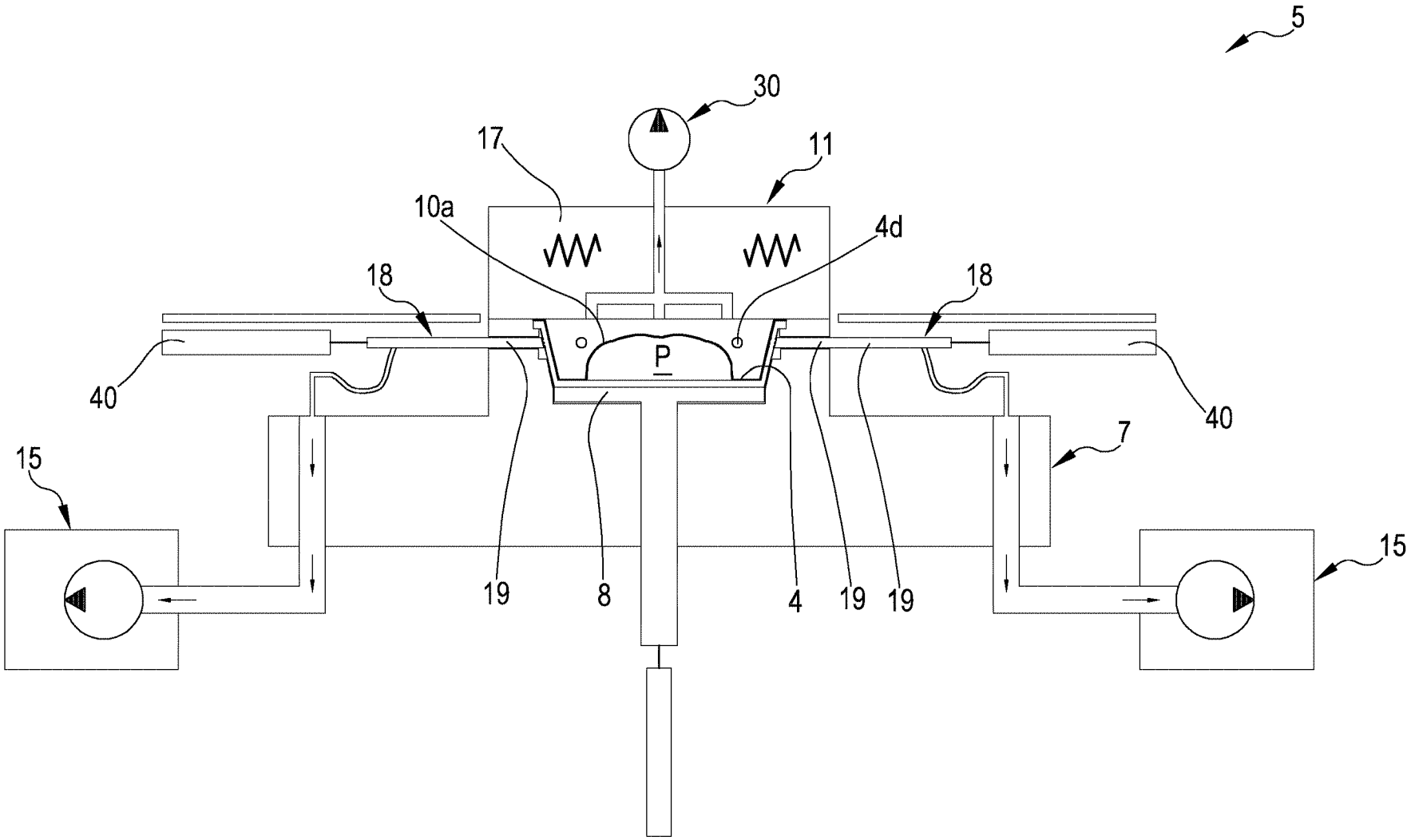
Figure 15:
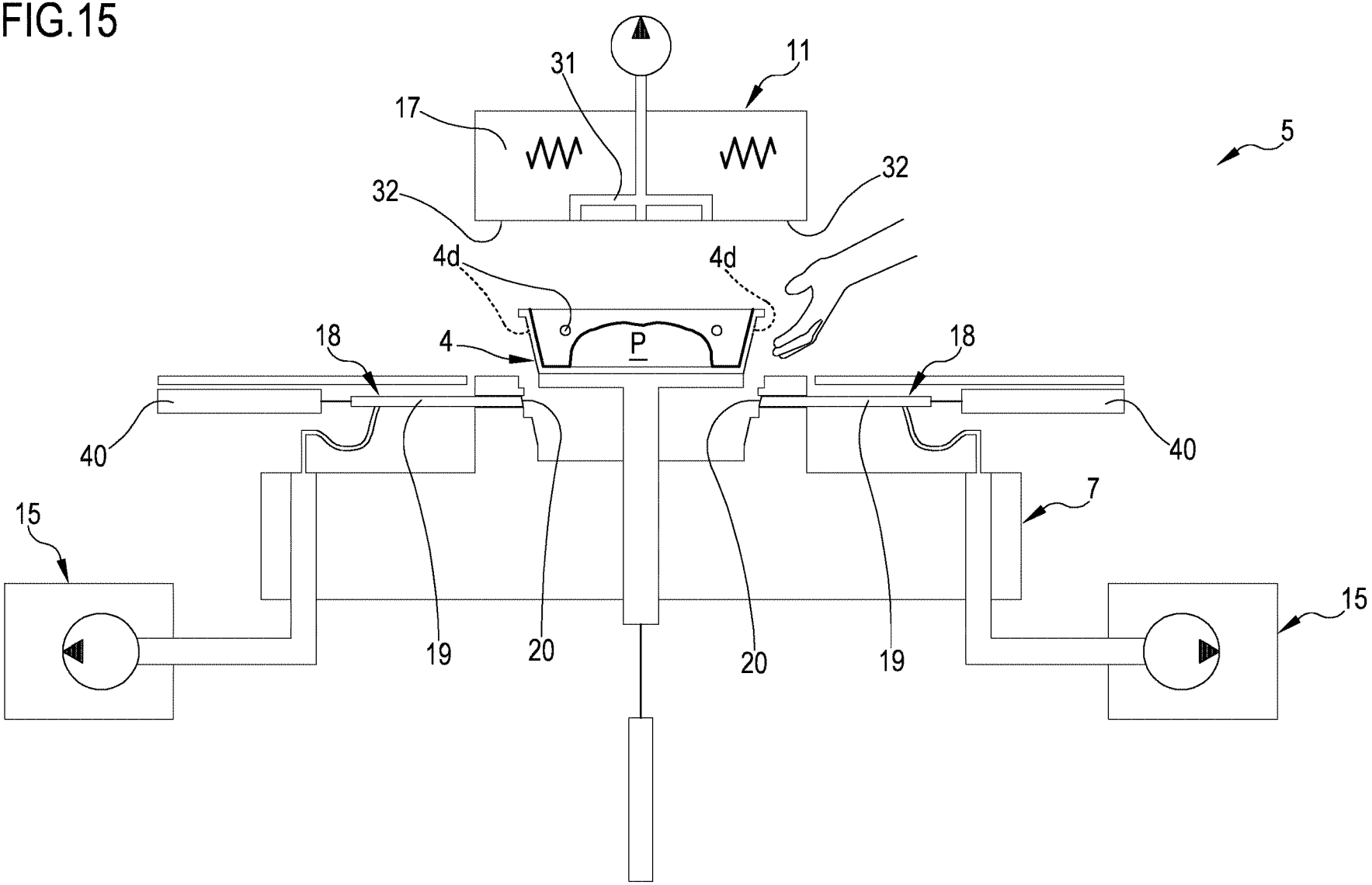
Figure 16A:
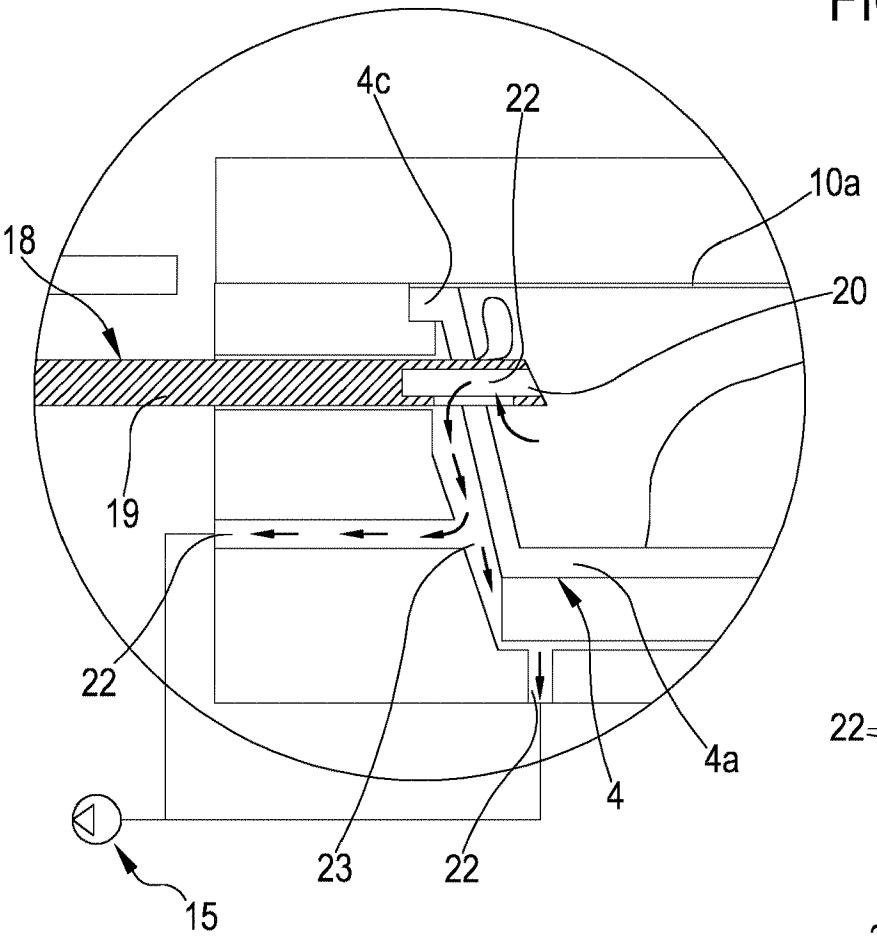
FIG. 16A is a detailed view of the packaging unit of FIG. 13.

As an alternative, the nozzle 19 may define the perforating tools 18 as shown in FIGS. 13-15. As a further alternative to the use of nozzles 19 or perforating tools 18, the supports 4 may have been provided with a respective number of holes before reaching the packaging units 5 (for instance the holes may be pre-formed in the base wall or in the side wall of the support during support manufacture).

In accordance with one aspect of the invention a packaging process obtained with the packaging infrastructure of the first embodiment is now described.

First of all the products or the product loaded supports are conveyed along the feed path by the feed line 6 which serves the various independent packaging units 5. Note that the supports 4 may be located on respective stacks next to the respective packaging units 5 such that either the feed line 6 simply conveys the product to be packaged to each packaging unit 5 while the supports are stacked at each packaging unit or, alternatively, the supports are conveyed along the feed path and each filled (manually or automatically) with a respective product and then the product loaded supports brought to each packaging unit 5.

An operator at each packaging unit 5 then picks the product loaded support from the feed line 6 or separately picks the support 4 and the product P and positions them in the lower tool 7 of each packaging unit 5. As it will be further explained an operator is serving two immediately adjacent packaging units per time (see FIGS. 2, 2A, and 4) such that while the operator may load the support 4 and the related product in one packaging unit 5, the other may perform the steps of the packaging cycle necessary to obtain one or more finished packages.

The overall packaging process executed by the packaging facility 1 comprises a plurality of packaging cycles executed at each packaging unit 5.

In particular, if with the facility 1 it is intended to obtain vacuum skin packages, then for each one of said plurality of distinct packaging units—the process of packaging comprises executing a respective packaging cycle including the following steps:

- positioning one or more product loaded supports in the respective seat of the lower tool 7 (in the example of FIGS. 2, 2A, and 4 one operator is supposed to position two supports 4 and related products P in the two seats 8 present in the lower tool of each packaging unit 5),
- positioning a respective film portion 10*a* above the one or more product loaded supports (this step may be made manually by an operator pulling the film portion from the plastic film roller associated to each packaging unit),
- removing gas from the volume between each product loaded support and the respective film portion 10*a* through the one or more through holes 4*d* formed in each one of said one or more supports 4 or through the one or more nozzles 19 inserted between each product loaded support and the respective film portion 10*a;*
- tightly fixing the film portion 10*a* to said one or more supports 4 present in the lower tool to form one or more packages.

In case it is instead desired to form a controlled atmosphere in one of more packages, then after the step of removing gas each packaging cycle in each packaging unit would include a step of injecting a controlled gas composition into the volume between each product loaded support and the respective film portion 10*a*: the step of injecting may rely on the one or more through holes 4*d* formed in each one of said one or more supports 4 or on one or more nozzles 19 inserted between each product loaded support and the respective film portion 10*a*. Note the step of injecting may star before the step of gas removing is completely ended.

Going in further detail, the packaging cycle—for each one of said plurality of distinct packaging units 5—may provide a step of holding the film portion while the step of gas removing (and if present of injecting a controlled composition of gas) is taking place; in practice this step of holding includes bringing the film portion in contact with the heating platen or with the heating surfaces of the upper tool 11 to heat the same film portion 10*a* either in a substantially uniform manner or creating two areas at different temperatures (first and second temperatures as disclosed above). The step of holding the film portion 10*a* may take place by evacuating gas from above the film portion 10*a* through the suction apertures 31 located at the operative surface 32 of the upper tool 11. In a possible variant, the film portion 10*a* may be held in contact with the heater 17 also while being positioned above the product loaded support and while an airtight contact is formed between the film portion and the support, thereby controlling position and temperature of the film portion in a virtually perfect manner.

Contemporaneously to, or after at least an initial phase of said gas removing, the packaging cycle comprises releasing the film portion 10*a* from the upper tool 11 such that at least a part of the film portion 10*a* displaces from the heater 17 and moves towards the support 4: once the film portion 10*a* reaches the support 4 the packaging cycle provides for the film portion 10*a* to contact the product P on the support 4 while heat bonding to a free surface of the support surrounding the product, thereby forming a sort of plastic skin on and around the product P and on the free upper surface of the support.

If, after gas removal, a step of injecting gas of controlled composition takes place then the film is released while or after the injection of gas and simply heat bonded at its periphery to a periphery of the support 4 in order to form a fluid tight package hosting the product and a predetermined quantity of gas at a controlled composition. Note that the step of releasing the film portion 10*a* may also include pushing the film portion towards the underlying product loaded support by introducing gas through said or other apertures present on the operative surface of the upper tool.

According to the first embodiment of the invention, to efficiently and quickly evacuate gas from (or inject gas into) the volume between each support 4 and the respective film portion 10*a*, the packaging cycle in each packaging unit may rely on the presence of one or more holes in the support wall 4*b* which may be either preformed or made by displacing the perforating tools 18 from the rest to the operative position. In this case, once the necessary quantity of gas has been removed (or injected) the step of tightly fixing the film portion 10*a* to said one or more supports 4 present in the lower tool 7 comprises heat bonding the film portion 10*a* to a peripheral border of each support 4 (and in case of formation of vacuum skin packages also to a superior surface of each support not occupied by the product), and closing the at least one through hole 4*d* in the wall of each support 4. Note that in accordance with an aspect—after an airtight contact is formed between the film portion and a peripheral border of each one of said one or more supports and before closing all the through holes present in each support—gas may continue to be evacuated from said volume through the one or more through holes 4*d* thus leading to a very efficient vacuum effect.

Alternatively, and always according to the first embodiment of the invention, to efficiently and quickly evacuate gas from (or inject gas into) the volume between each support and the respective film portion 10*a*, the packaging cycle in each packaging unit 5 may rely on the presence of suction nozzles 19 positioned between the film portion 10*a* and the support 4. In this case, the packaging cycle—for each one of said plurality of distinct packaging units 5—comprises the following further steps:

- positioning the nozzle 19 in an interspace between an upper surface 4*f* of the support and a bottom surface of the film portion 10*a*,
- removing gas by evacuating air from below the film portion by sucking gas through a suction aperture 20 of the nozzle 19 (this step being followed by injection of a controlled gas composition if a package under controlled atmosphere needs to be made);
- releasing the film portion 10*a* and allowing the film portion to contact the product and tightly fix to the free surface of the support (or to at least a perimeter of the free surface of the support), and then
- removing the nozzle 19 from said interspace by relatively displacing the nozzle with respect to the support.

It should be noted that the step of gas removing or the step of injecting a controlled gas composition starts only after the upper 11 and lower tools 7 are brought in said second position wherein the chamber 21 defined by the upper and lower tools is only configured to be placed in communication with at least one of the vacuum arrangement 15 and the controlled atmosphere arrangement 16.

In accordance with one aspect of the first embodiment of the invention the packaging cycle—for each one of said plurality of distinct packaging units 5—comprises providing each support 4 in each packaging unit with a plurality of through holes 4*d* such that the following relationship is satisfied:

$$(N \cdot A) > K \cdot VC, \tag{1}$$

wherein:

N: number of holes in each support,

A: area of fluid passage of each hole in $mm^2$,

VC: reference volume in $mm^3$,

K: a constant$=5 \cdot 10^{-6} \cdot mm^{-1}$.

Note that if the support 4 is a tray having a polygonal base wall 4*a* and a side wall 4*b* emerging from the base wall, the at least one thorough hole 4*d* is preferably positioned in respective corners of the side wall, optionally in one or more horizontal ledges present in the upper half of the side wall.

Furthermore note that, according to a further aspect, during said step of removing, gas is withdrawn from the chamber 21 through said one or more through holes 4*d* and/or through said one or more nozzles 19 for a gas withdrawal period lasting between 0.5 to 6.0 seconds, preferably between 1.0 to 3.0 seconds.

In accordance with an alternative aspect of the first embodiment of the invention the packaging cycle—for each one of said plurality of distinct packaging units 5—comprises providing each support 4 in each packaging unit 5 with a plurality of nozzles 19 such that the following relationship is satisfied:

$$(N \cdot A') > K \cdot VC, \tag{2}$$

wherein:

N: number of nozzles active on each support,

A': area of fluid passage through each nozzle in $mm^2$,

VC: reference volume in $mm^3$,

K: a constant$=5 \cdot 10^{-6} \cdot mm^{-1}$.

Note that, according to a further aspect, during said step of injecting a controlled gas composition, gas is injected into the chamber 21 through said one or more through holes 4*d* and/or through said one or more nozzles 19 for a gas injection period lasting between 0.2 to 2.0 seconds, preferably between 0.3 to 0.8 seconds.

In both the above alternative formulas (1) and (2) VC is a volume of reference relating to each support inside each packaging unit 5.

In case of flat supports the reference volume VC is the ideal vertical volume between the upper surface of the support 4 and the lower surface of the upper tool when the upper and lower tools are in the second position and form a closed chamber. In other words, the reference volume VC (see FIG. 16C where VC is shown for a flat support 4—in this figure VC volume is shown with rendering) is measured vertically projecting the peripheral border of the support 4 towards the respective film portion located above the support 4.

Figure 11:
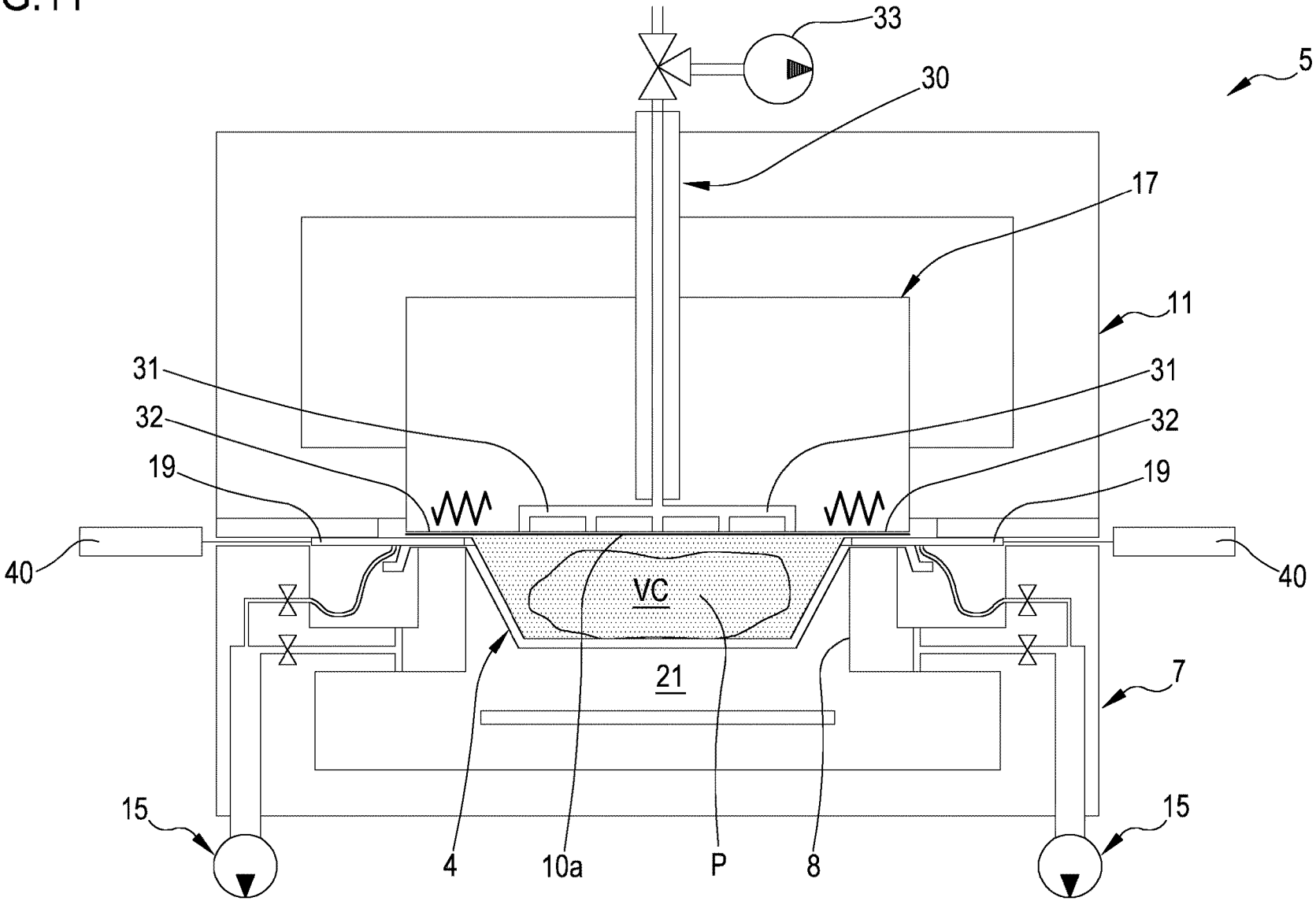
FIGS. 11 and 12 show a further possible structure of a packaging unit of the facility of FIG. 1-4 during various phases of a packaging cycle.
Figure 12:
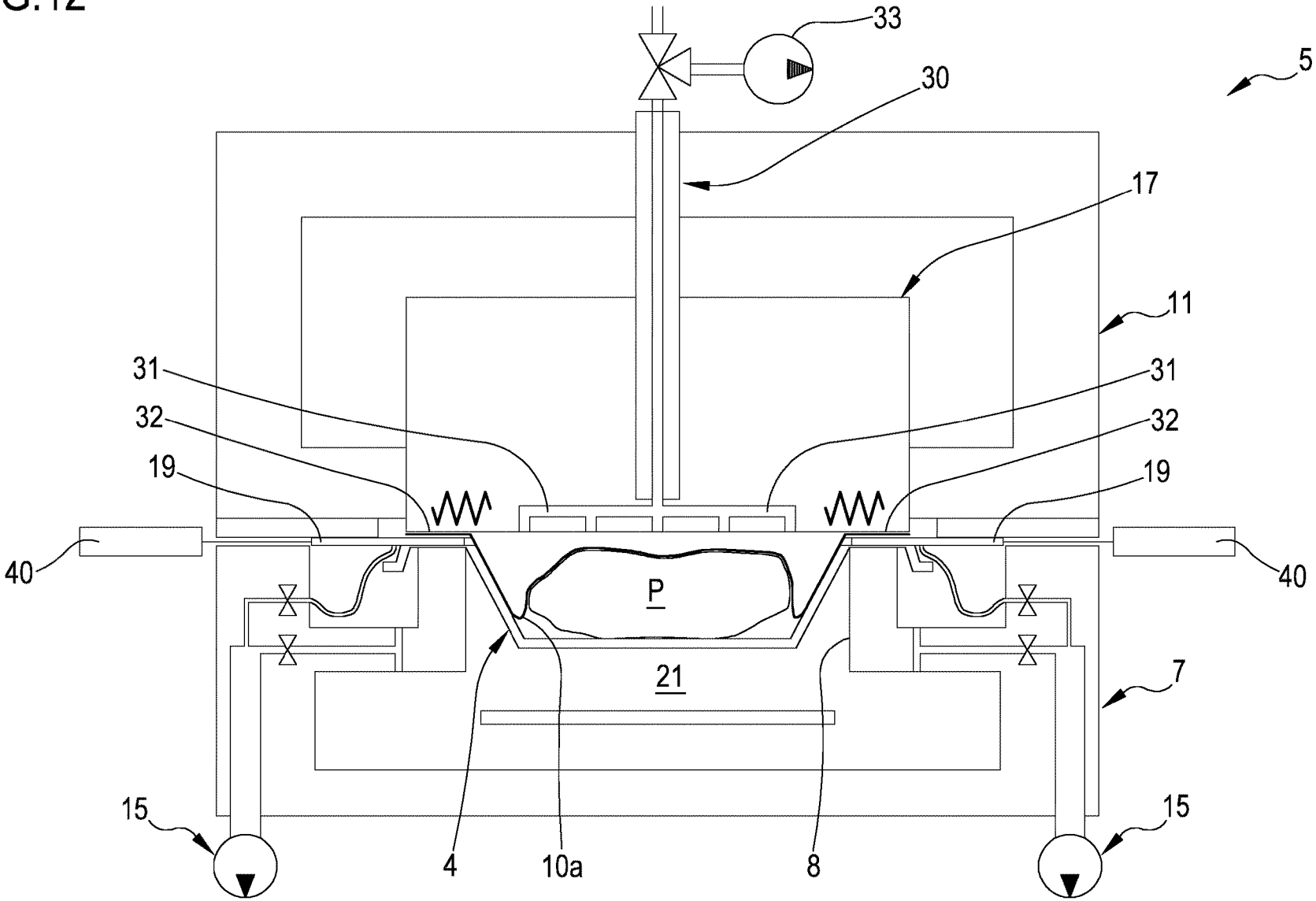

VC, instead, is the inner volume of the support 4 in case of supports in the form of trays: in practice this volume is defined by the upper surface of the tray and an ideal horizontal plane tangential to the tray side wall top flange (see VC in FIG. 11, where VC volume is shown with rendering).

Figure 19:
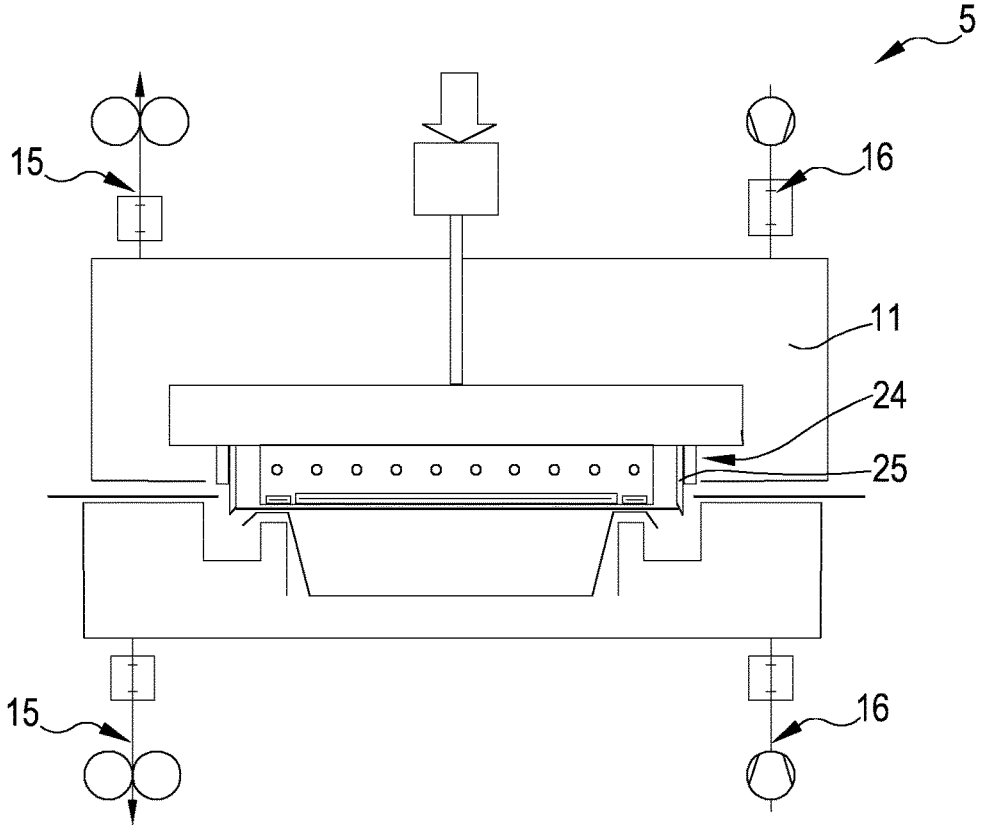

It has already been explained that each packaging unit 5 be provided with a own independent film supply 9 including a film roll: the film roll provides a continuous web of film which is unwound from the film roll and a cutting operation takes place, either outside the packaging unit (see FIG. 20) or inside each packaging unit (see FIGS. 18 and 19), to cut the continuous web of film into film portions 10*a* having each the size of one or more supports 4.

Figure 16B:
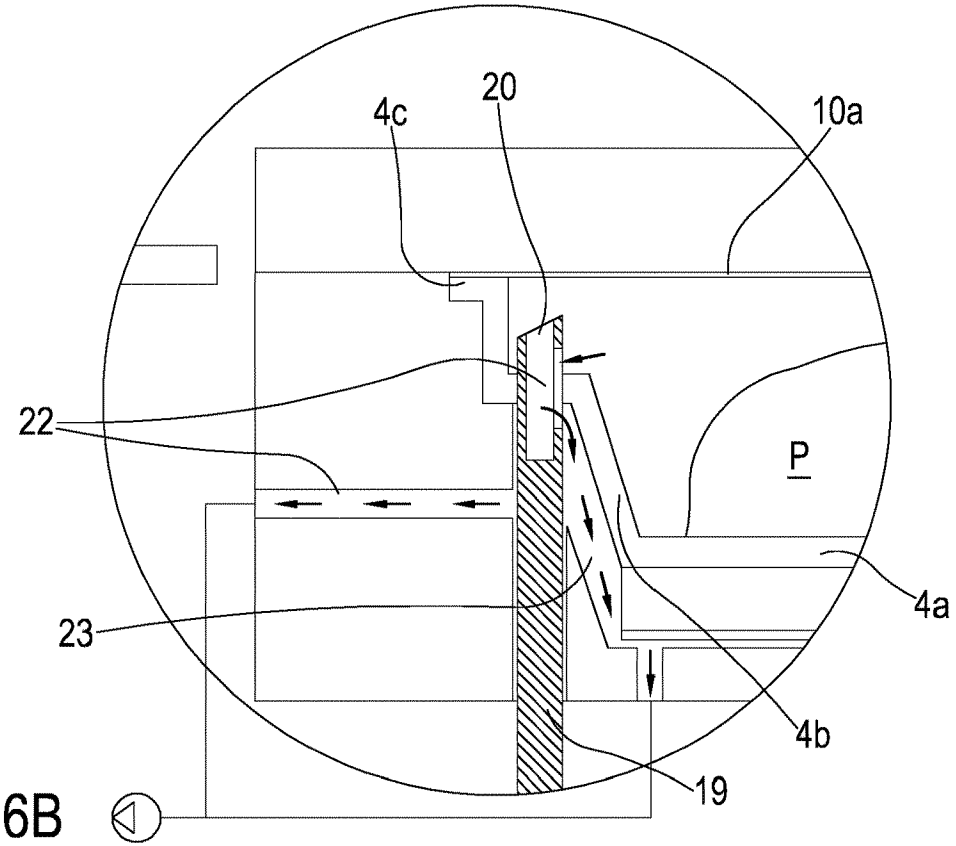
FIGS. 16B and 16C are detailed views of further different possible structures of the packaging unit according to FIGS. 13-15.
Figure 16C:
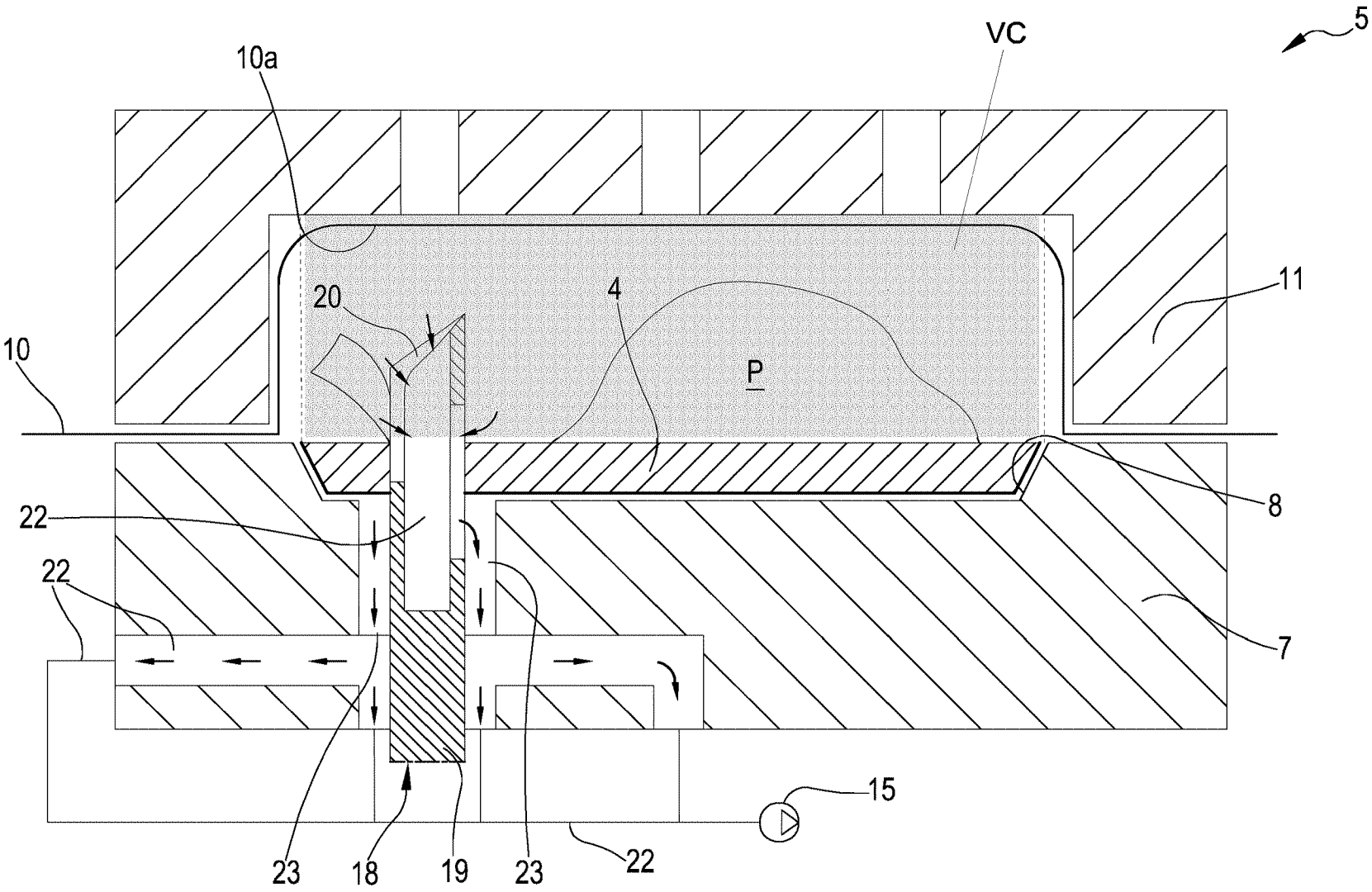

Furthermore, each perforating tool 18 and/or each nozzle 19 in each packaging unit 5 comprise an inner channel 22 connected to the vacuum arrangement 15 such that removal or respectively injection of gas also take place through said inner channel 22. In particular, the step of removing at least part of the gas takes place via the inner channel 22 of each perforating tool and/or of each nozzle: note that preferably however the inner channel 22 is connected to the vacuum arrangement 15 via a volume 23 (see FIGS. 16A-16C) defined in the lower tool 7 and external to the support 4 when this latter is positioned in the lower tool seat 8. This last provision helps in keeping the support 4 in position and avoid support structural collapsing during gas withdrawal.

To summarize, the facility 1 allows contemporaneous execution of packaging cycles at each of the above described packaging units 5 which are provided with appropriate means (perforating tools 18 and/or nozzles 19) allowing to optimize the time necessary for performing the necessary steps of gas withdrawal and if necessary gas injection. Thus, the process includes:

- displacing one or more of the products, or the supports, or the product loaded supports along the feed path of the feed line 6, such that each independent packaging unit 5 is periodically approached by one or more of said products or supports or product loaded supports,
- periodically picking from the feed line 6 the one or more products or supports or product loaded supports which has/have approached one of said packaging units 5 and placing it/them in the respective seat/seats in said packaging unit,
- executing said packaging cycles at each of the units, and extracting the packages from each packaging unit.

As shown in FIGS. 1-4, and 17 the plurality of packaging units 5 may be positioned adjacent to the feed line 6: in a preferred solution the feed line 6 defines a straight feed path and the packaging units are positioned adjacent to each side of the feed line.

According to an advantageous aspect, two consecutively adjacent packaging units 5 positioned on a same side of the feed line 6 (and served by a same operator) execute the respective packaging cycle such that while in one of said two consecutive packaging units one or more of the following steps are taking place:

- positioning each of the one or more product loaded supports in the respective seat of the lower tool and
- positioning the film portion 10*a* above the one or more product loaded supports, while in the other of the two consecutive packaging units 5 one or more of the following steps are taking place:

- removing gas from, or injecting a controlled gas composition into, said volume between each product loaded support and the respective film portion,
- tightly fixing the film portion to said one or more supports present in the lower tool to form one or more packages.

In practice one operator may serve two adjacent units 5 at the same time: the operator may take care of the steps of positioning the product and the support or the product loaded support into the lower tool 7 on one unit 5 while the other unit 5 is forming the package (either a vacuum skin package or a controlled atmosphere package). This condition is illustrated on FIG. 10.

Note, that according to the first embodiment, each packaging unit 5 relies on the holes present on the support 4 or on the nozzles 19 in order to minimize the time needed for removing/injecting gas. It has been noted that the time for one packaging unit 5 to complete the steps of removing and injecting gas using the above provisions is comparable to the time an operator takes for loading one/two seats of a packaging unit 5 and properly positioning the film portion 10*a*, thereby leading to an optimization of the overall packaging process offered by the facility.

Figure 17:
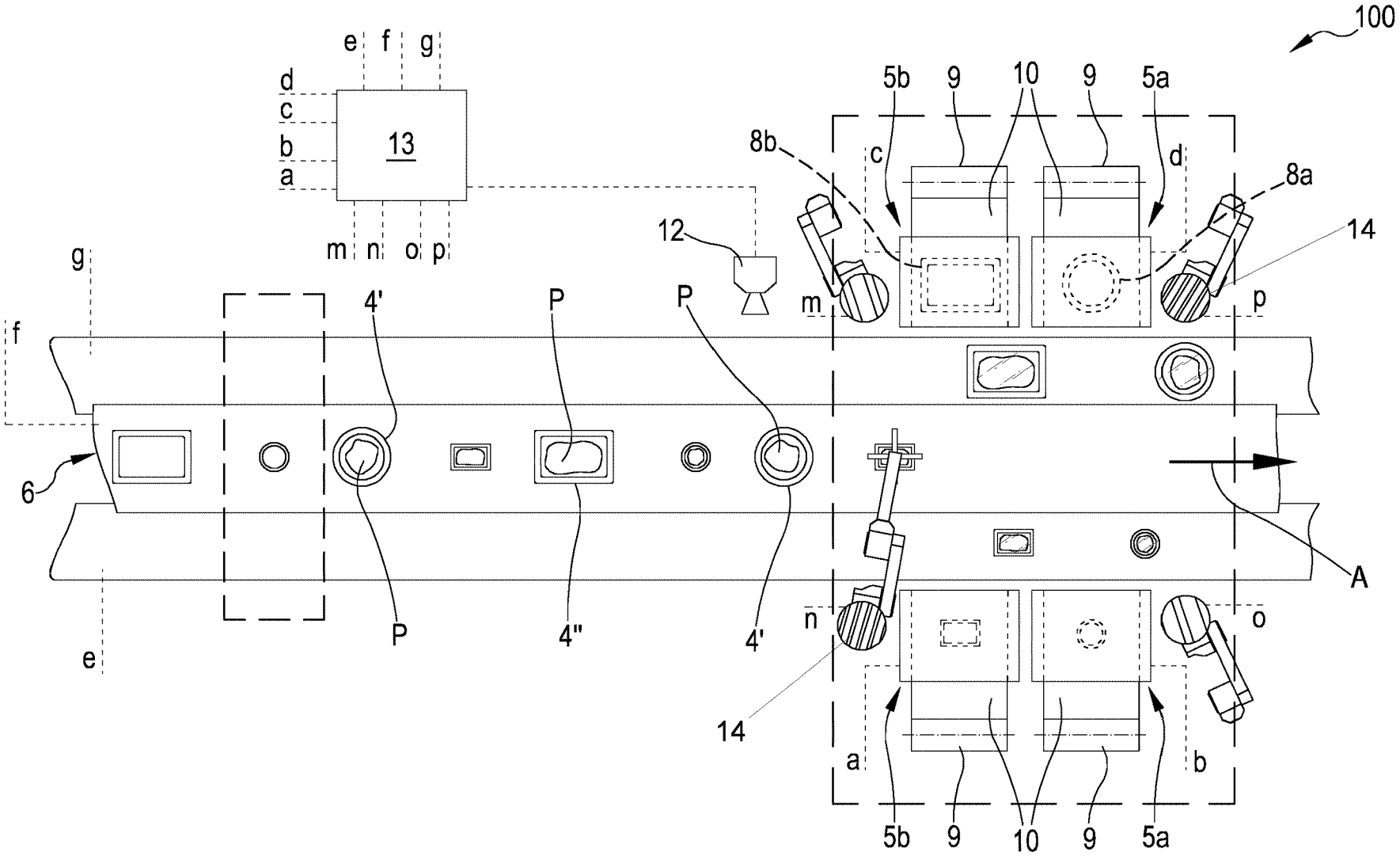
FIG. 17 shows a layout of a second embodiment of a packaging facility according to certain aspects of the invention.
Figure 18:
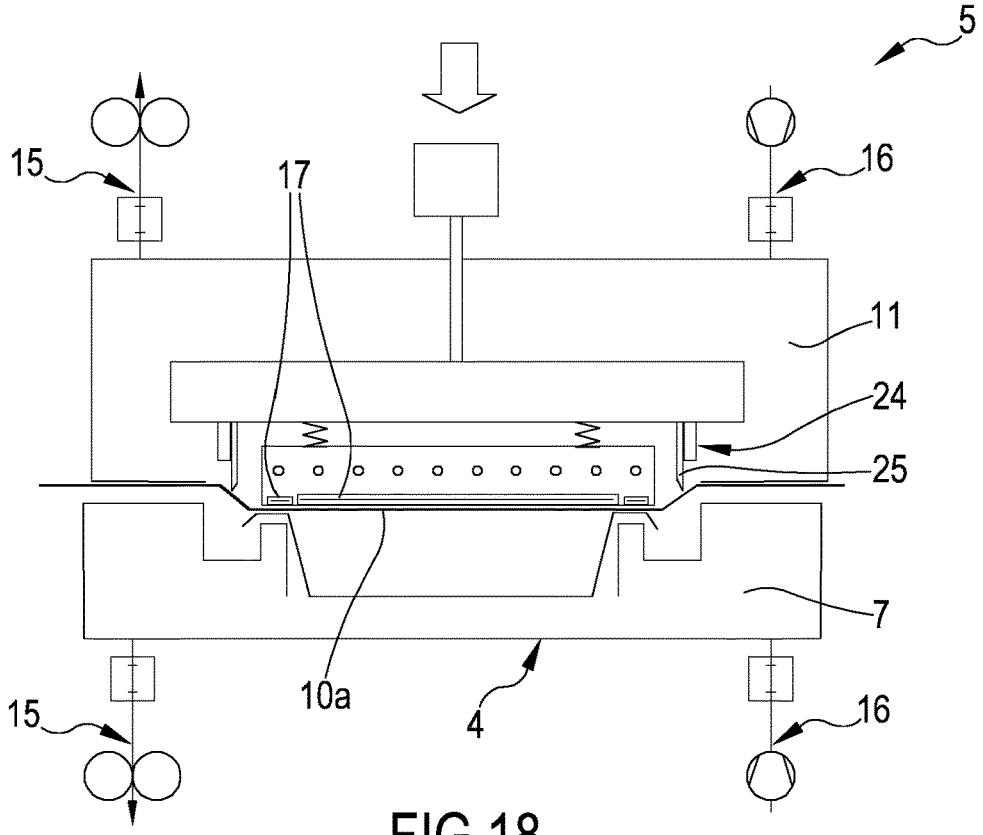
FIGS. 18 and 19 show a possible structure of a packaging unit of the facility of FIG. 17 during various phases of a packaging cycle.

FIG. 17 show a modular packaging facility 100 according to a second embodiment of the invention. Also the modular packaging facility 100 is configured for executing a packaging process using multiple independent packaging units 5 each designed to effect an own independent packaging cycle.

Similar to the first embodiment, the packaging facility 100 comprises a plurality of independent packaging units 5 each configured to receive one or more product loaded supports. The facility 100 also includes at least one feed line 6 extending along a prefixed feed path and serving the plurality of packaging units 5, which are positioned along the feed line. For example, the feed line may include at least one conveyor 6*a* for displacing the products P, or supports 4, or the product loaded supports, along the feed path. In an alternative and similar to the first embodiment, the supports 4 may be stacked next to each packaging unit 5 instead of being transported by the conveyor 6*a*, which may therefore be used for transportation of the products P. The conveyor or the conveyors are driven by a motor, preferably an electric motor 6*b*, under the control of an own control unit 13 active on the motor or under the control of a control unit part of the infrastructure control system. This control unit 13 is programmed or configured to control the conveyor to move either in a step by step manner or at a predetermined constant speed, such that the products or the supports or the product loaded supports be displaced along the feed path at a regular pace. Note that it may be envisaged that the infrastructure comprise a discharge path 6*c*, also including one or more conveyors, and adapted to receive the packaged products once extracted from the respective unit 5 at the end of the packaging cycle.

Each one of the packaging units 5 has a lower tool 7 configured to define one or more seats 8 for receiving the one or more product loaded supports. In the example shown in the figures, each lower tool 7 defines two adjacent seats 8 each for receiving a respective support such as to be able to make two packages per packaging cycle. Each unit 5 also has a film supply 9, which in the example shown includes at least a roll of plastic film, configured for supplying a film to be applied to the product loaded supports hosted in the seat(s) of the lower tool. Furthermore, each one of the packaging units 5 includes an upper tool 11 cooperating with the lower tool. In greater detail, the upper tool and the lower tool are relatively movable the one with respect to the other (for example under the action of one or more actuators)

between at least a first position, where the two tools are spaced from one another such as to allow access of the product loaded supports into the seats of the lower tools and positioning of at least one portion of the plastic film above the lower tool, and a second position, allowing coupling of the film portion(s) to the respective support(s). Once the upper and lower tool are in the second position, they define a closed chamber 21, preferably a fluid tight closed chamber, which communicates with the arrangements necessary to create a vacuum or to create a controlled atmosphere inside the same chamber. When the chamber 21 is closed the actual packaging cycle takes place as explained herein below. Each one of the packaging units is also provided with a vacuum arrangement 15 configured for removing gas from a volume between each support received by the lower tool and the respective film portion 10*a*, which is located above the same product loaded support. In a variant, each one of the packaging unit comprises the vacuum arrangement 15 and also a controlled atmosphere arrangement 16 (see FIGS. 18 and 19) configured to inject a controlled gas composition in said volume in order to create packages which are tightly closed maintaining inside the package a gas composition which is different from the natural atmospheric composition at sea level.

Moreover, also according to the second embodiment, the upper tool 11 of each distinct packaging unit 5 is provided with a heater 17 and is configured for holding at least one film portion 10*a* above the respective product loaded support hosted in the lower tool 7: in practice the heater 17 may be in the form of any known heating means such as a heated fluid or a resistance or an irradiating element and the holding ability may be provided by mechanical holder or by pneumatic holders 30 (for instance a set of suction holes 31 distributed on an active surface 32 of the upper tool 11 and connected to a suitable vacuum source 33). Thus, the upper tool has the task to receive the film portion 10*a* from the film supply 9 and to keep is just above the respective seat 8 in the lower tool 7, also providing for the heating necessary to bring the film portion 10*a* to the temperature required for the specific cycle and for the heat bonding of the film portion to the respective support. The heater 17 of each one of the independent packaging units 5 may comprise a single heating platen 17*a*, optionally a flat or a dome shaped heating platen, or it may comprise a peripheral bar 17*a* and a central heating element 17*b* provided with respective heating means and with ability to move relative to each other such that a peripheral band of the film portion may be heated by the heating bar to a first temperature ideal for heat bonding while the central zone of the film portion may be brought by the central heating element to a second temperature (typically lower than the first temperature) for instance ideal for thermal shrink of the plastic film.

In accordance with an aspect of the invention, which is shown in connection with the second embodiment, but which may also be applied to the first embodiment described above, the packaging units 5 of the facility comprise packaging units where the lower tools 7 are configured for receiving supports 4 of different types. In greater detail a number of first packaging units 5*a* have a lower tool defining seats 8*a* configured for receiving supports 4' of a first type, and a number of second packaging units 5*b* have a lower tool defining seats 8*b* configured for receiving supports 4" of a second type. The supports 4' of the first type differ from the supports 4" of the second type at least in one geometric property, which may be the shape, the size of one or more dimensions like height (or thickness in case of flat supports), width, length or other (see definition section).

Figure 21:
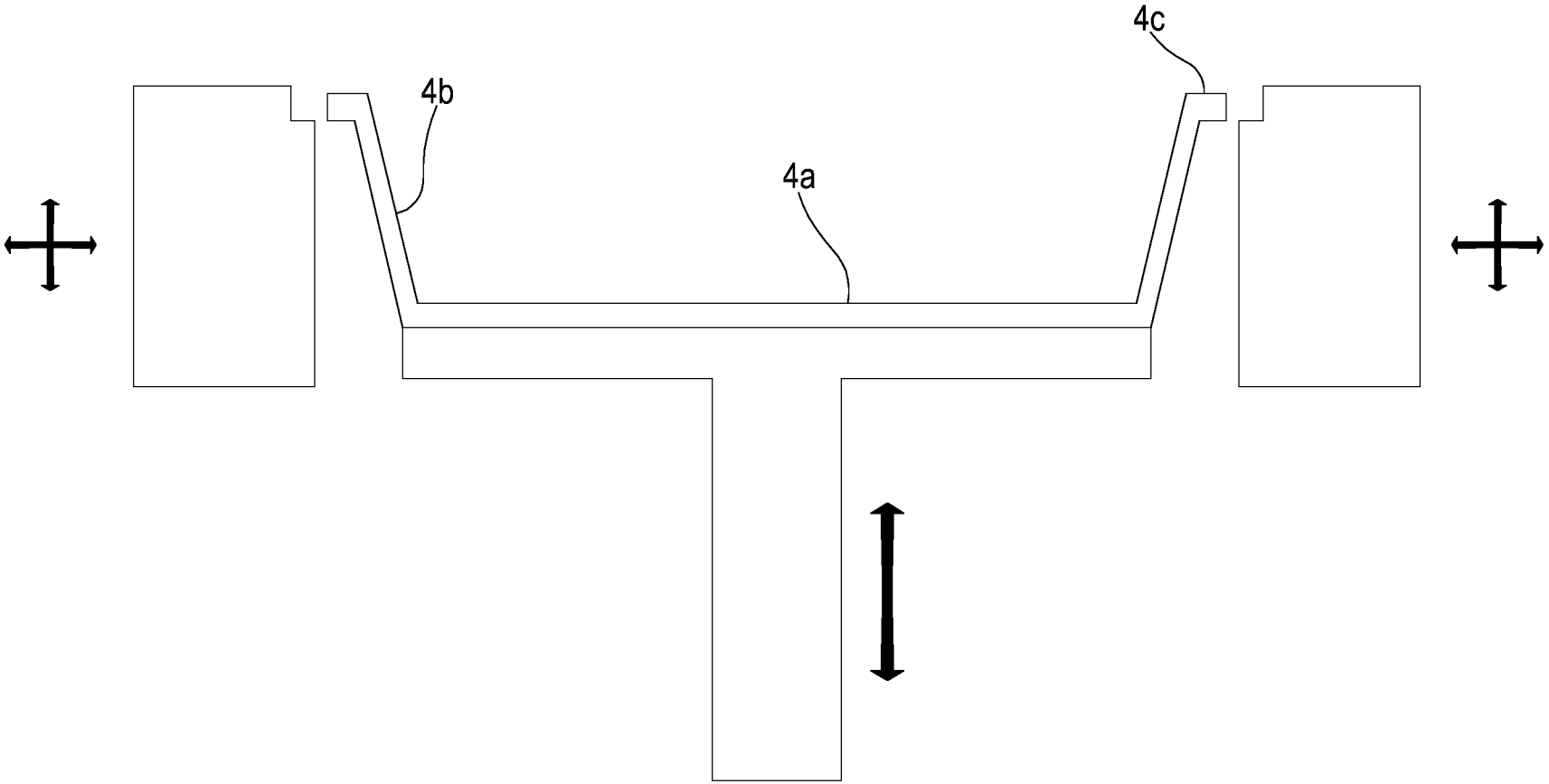
FIG. 21 depicts a seat that is adjustable in shape and/or size to receive two or more types of supports differing from each other for at least one geometric property.
Figure 22:
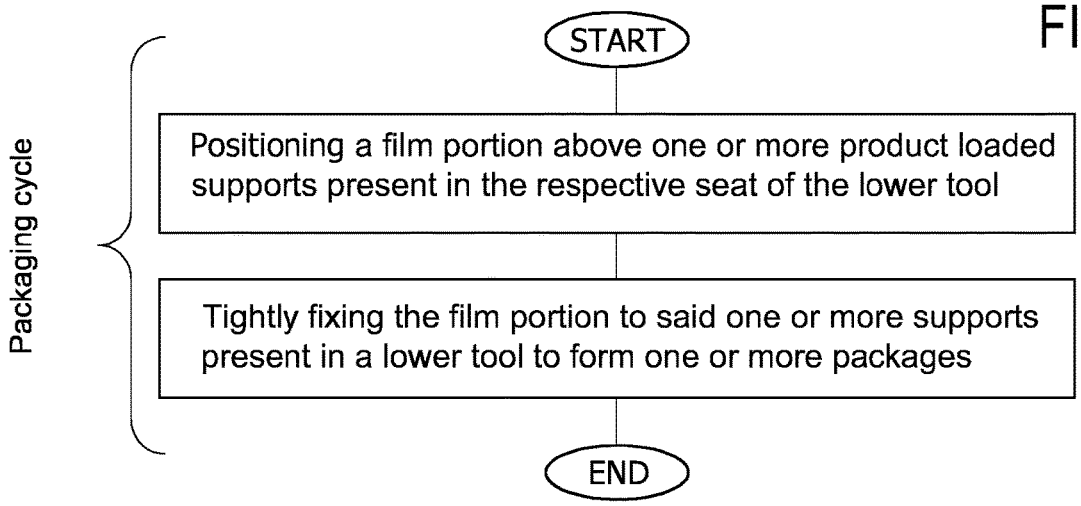
FIG. 22 depicts a packaging cycle that includes positioning a film portion above one or more product loaded supports and tightly fixing the film portion to the one or more supports.
Figure 23:
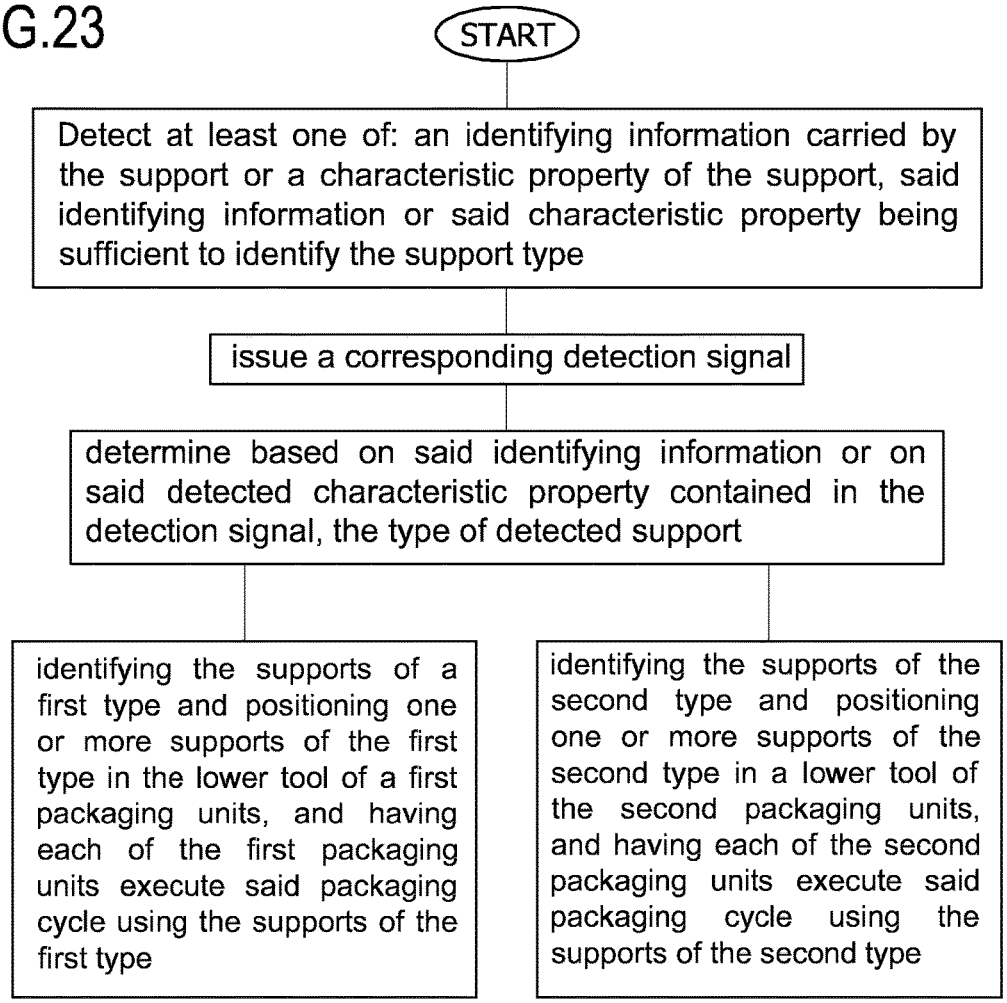
FIG. 23 depicts a method that includes detect at least one of an identifying information carried by the support or a characteristic property of the support, issuing a corresponding detection signal, and determining, based on the identifying information or on the detected characteristic property contained in the detection signal, the type of detected support.

Note that either the lower tools have seats of fixed geometry or the lower tool of each of the packaging units has adjustable seats: for example the seat may be adjustable in shape and/or size to receive two or more types of supports differing form each other for at least one geometric property (see FIG. 21). The adjustable seats may be manually adjustable upon intervention of an operator who may act on adjusting means to obtain the desired shape or size, or the seats in the lower tools may be automatically adjustable as shown in the attached drawings.

In accordance with another aspect of the invention, which is shown in connection with the second embodiment, but which may also be applied to the first embodiment described above, the facility 100 comprises a detector 12 operatives at a detecting station located at, or in proximity of, the feed line 6 and positioned upstream the packaging units 5 with respect to a direction A of displacement of the supports 4 or product loaded supports along the feed path. The detector 12 may be a camera collecting images of the items (supports or product loaded supports) crossing the detecting station, or the detector 12 may be a more simple detector such as an emitter/receiver assembly configured to emit electromagnetic or an acoustic wave sequence and to receive a feedback signal scattered and/or reflected by the items (supports or product loaded supports) crossing the detecting station, or the detector may be a reader configured to read information carried by the support. Other types of detector may be envisaged as long as the detector is configured to detect at least one of: an identifying information carried by the support sufficient to identify the support type, or a characteristic property of the support sufficient to identify the support type. The detector 12 is also configured to issue a detection signal corresponding to the detected identifying information or detected characteristic property such as to allow a control unit to deduct the type of support detected. The facility 100 includes, in this respect, a control system comprising one or more control units 13 (of the analog or digital type) connected to the detector 12 and configured to receive from the detector the detection signal and determine—based on said identifying information or on said detected characteristic property contained in the detection signal—the type of detected support. In other words, the control system (and in particular either a central control unit or a peripheral control unit associated to the detector) are able to extract the identifying information or the characteristic property from the detection signal and based on this determine whether a detected support is of the first or of the second type. In the present description, the example of two types of support and related seats has been made: however, the facility may be configured to operate in an analogous manner with supports of three, four, five or more types (see FIG. 17). In a possible alternative, each support 4 has a respective identification medium—such as a bar code or a quad code or an RFID or a color code—carrying said identification information and the detector in the form of an electromagnetic reader may be configured for reading said identification medium. Alternatively, the detector 12 may configured for detecting said characteristic property—such as a directly support geometric property or a support physical property (e.g., weight).

Once the control system has detected the type of support passing through the detecting station at least one control unit 12 of the control system is configured to issue a control signal, which may be a signal indicative of the type of detected support (e.g., support of type 1, or support of type 2, . . . , support of type n), or directly a command indicative of the packaging unit 5 to be used with the detected support 4 (in other words the control unit understands which type of support is coming and commands use of a corresponding packaging unit adapted to receive the identified support).

According to a further aspect of the invention, which is shown in connection with the second embodiment, but which may also be applied to the first embodiment described above, each packaging unit 5 is equipped with a respective control device communicating with the facility control system or with part of the facility control system (e.g., with a central control unit of the facility control system) and configured to receive said control signal and to automatically adjust the seats in one or more lower tools 7 based on the type of detected support. Moreover, a sorting device 14 connected to and controlled by said control system, may be configured for:

receiving said control signal from the control unit 13, and based on said control signal positioning one or more supports 4 in the corresponding packaging unit 5.

Note the sorting system 14 may have an own control device connected to the facility control system or it may be directly controlled by the control system. Irrespective of the type of solution adopted the controller of the sorting system 14 is configured for:

receiving the control signal from said control unit 13 of the facility control system or simply analyzing said signal if the facility control system directly acts on the sorting system, based on said control signal positioning the supports 4' of the first type in the lower tool of the first packaging units 5*a* and the one or more supports 4" of the second type in the lower tool of the second packaging units 5*b*, Under a structural point of view the sorting system 14 may include at least one robotized handler configured to pick a support, or a product loaded support, form the feed line 6 and move it into the appropriate lower tool of a packaging unit, as described above.

Finally, according to a yet and additional aspect of the invention, which is shown in connection with the second embodiment, but which may also be applied to the first embodiment described above, each packaging unit 5 includes a number of sensors connected with the control device of the packaging unit. These sensors include sensors configured for detecting when the respective packaging unit falls in an alarm condition. The alarm conditions detectable by the sensors may be one of the following alarm conditions:

the packaging unit is not operative (in this case a power sensor is used connected with the control device), the packaging unit is not provided with a sufficient supply of plastic film (in this case a proximity sensor or a sensor of presence or a weight sensor may be used), the packaging unit is experiencing a fault condition (in this case the type of sensor or sensors used depends upon the condition to be detected).

The sensor or sensors is/are configured to issue a warning signal corresponding to the detected alarm condition: the control device associated to each one of the packaging units 5, which is connected to the control system of the facility, is configured to receive said warning signal(s) and to issue corresponding alarm signals to said control unit of the facility, which becomes therefore informed about the conditions of the packaging units part of the facility. On its turn, the control unit or control system of the facility may be configured for controlling the sorting device to prevent positioning one or more supports or product loaded supports in the lower tool of the packaging units for which the alarm condition has been detected.

Note that although the second embodiment may use traditional type of packaging cycles, the packaging facility 100 may also have packaging units 5 which—similar to those of the first embodiment, have at least one own perforating tool 18, optionally associated with the respective lower tool 7 of each packaging unit 5, and configured to form one or more through holes 4*d* in each support 4 received in said lower tool; and/or at least one nozzle 19 configured to be positioned in an interspace between an upper surface of the support and a bottom surface of the film portion 10*a*.

Accordingly, also in the second embodiment of the invention, to efficiently and quickly evacuate gas from (or inject gas into) the volume between each support and the respective film portion, the packaging cycle in each packaging unit may rely on the presence of one or more holes in the support wall 4*b* which may be either preformed or made by displacing the perforating tools 18 from the rest to the operative position. In this case, once the necessary quantity of gas has been removed (or injected) the step of tightly fixing the film portion 10*a* to said one or more supports 4 present in the lower tool 7 comprises heat bonding the film portion to a peripheral border of each support 4 (and in case of formation of vacuum skin packages also to a superior surface of each support not occupied by the product), and closing the at least one through hole 4*d* in the wall of each support. Note that in accordance with an aspect—after an airtight contact is formed between the film portion 10*a* and a peripheral border of each one of said one or more supports 4 and before closing all the through holes present in each support—gas may continue to be evacuated from said volume through the one or more through holes thus leading to a very efficient vacuum effect.

Alternatively, and always according to the first embodiment of the invention, to efficiently and quickly evacuate gas from (or inject gas into) the volume between each support and the respective film portion 10*a*, the packaging cycle in each packaging unit may rely on the presence of suction nozzles 19 positioned between the film portion 10*a* and the support. In this case, the packaging cycle—for each one of said plurality of distinct packaging units 5—comprises the following further steps:

positioning the nozzle 19 in an interspace between an upper surface 4*f* of the support 4 and a bottom surface of the film portion 10*a*, removing gas by evacuating air from below the film portion 10*a* by sucking gas through a suction aperture 20 of the nozzle 19 (this step being followed by injection of a controlled gas composition if a package under controlled atmosphere needs to be made);

releasing the film portion 10*a* and allowing the film portion to contact the product and tightly fix to the free surface of the support (or to at least a perimeter of the free surface of the support), and then removing the nozzle 19 from said interspace by relatively displacing the nozzle with respect to the support.

It should be noted that the step of gas removing or the step of injecting a controlled gas composition starts only after the upper and lower tools are brought in said second position wherein the chamber 21 defined by the upper and lower tools is only configured to be placed in communication with at least one of the vacuum arrangement 15 and the controlled atmosphere arrangement 16.

In a manner similar to the first embodiment, also in the second embodiment of the invention the packaging cycle—for each one of said plurality of distinct packaging units—comprises providing each support in each packaging unit with a plurality of through holes such that the following relationship is satisfied:

$$(N \cdot A) > K \cdot VC, \quad (1)$$

wherein:

N: number of holes in each support,

A: area of fluid passage of each hole in $mm^2$,

VC: reference volume in $mm^3$,

K: a constant=$5 \cdot 10^{-6} \cdot mm^{-1}$.

Note that if the support is a tray having a polygonal base wall and a side wall emerging from the base wall, the at least one thorough hole is preferably positioned in respective corners of the side wall, optionally in one or more horizontal ledges present in the upper half of the side wall.

Furthermore note that, according to a further aspect, during said step of removing, gas is withdrawn from the chamber through said one or more through holes and/or through said one or more nozzles for a gas withdrawal period lasting between 0.5 to 6.0 seconds, preferably between 1.0 to 3.0 seconds.

In accordance with an alternative aspect of the second embodiment of the invention the packaging cycle—for each one of said plurality of distinct packaging units—comprises providing each support in each packaging unit with a plurality of nozzles such that the following relationship is satisfied:

$$(N \cdot A') > K \cdot VC, \quad (2)$$

wherein:

N: number of nozzles active on each support,

A': area of fluid passage through each nozzle in $mm^2$,

VC: reference volume in $mm^3$,

K: a constant=$5 \cdot 10^{-6} \cdot mm^{-1}$.

Note that, according to a further aspect, during said step of injecting a controlled gas composition, gas is injected into the chamber 21 through said one or more through holes 4*d* and/or through said one or more nozzles 19 for a gas injection period lasting between 0.2 to 2.0 seconds, preferably between 0.3 to 0.8 seconds.

In both the above alternative formulas (1) and (2) VC is a volume of reference relating to each support inside each packaging unit 5.

In case of flat supports the reference volume VC is the vertical volume between the upper surface of the support and the lower surface of the upper tool when the upper and lower tools are in the second position and form a closed a chamber 21. In other words, the reference volume VC is measured vertically projecting the peripheral border of the support towards the respective film portion 10*a* located above the support 4 (see again FIG. 16C appears with rendering).

VC, instead, is the inner volume of the support 4 in case of supports in the form of trays: in practice this volume is defined by the upper surface of the tray and an ideal horizontal plane tangential to the tray side wall top flange (FIG. 11 where VC appears with rendering).

In case the packaging units 5 are provided with a perforating tool 18 and/or with a nozzle 19, it should be noted that the perforating tool and/or the nozzle have an inner channel 22 connected to the vacuum arrangement 15 of the respective packaging unit 5 such that upon operation of the vacuum arrangement removal of at least part of the gas takes place via the inner channel 22 of each perforating tool 18 and/or of each nozzle 19. In greater detail, the inner channel 22 is preferable connected to the vacuum arrangement via a volume 23 defined in the lower tool and external to the support when this latter is positioned in the lower tool seat to avoid risks of displacement or of structural collapsing of the support during gas evacuation.

Figure 20:
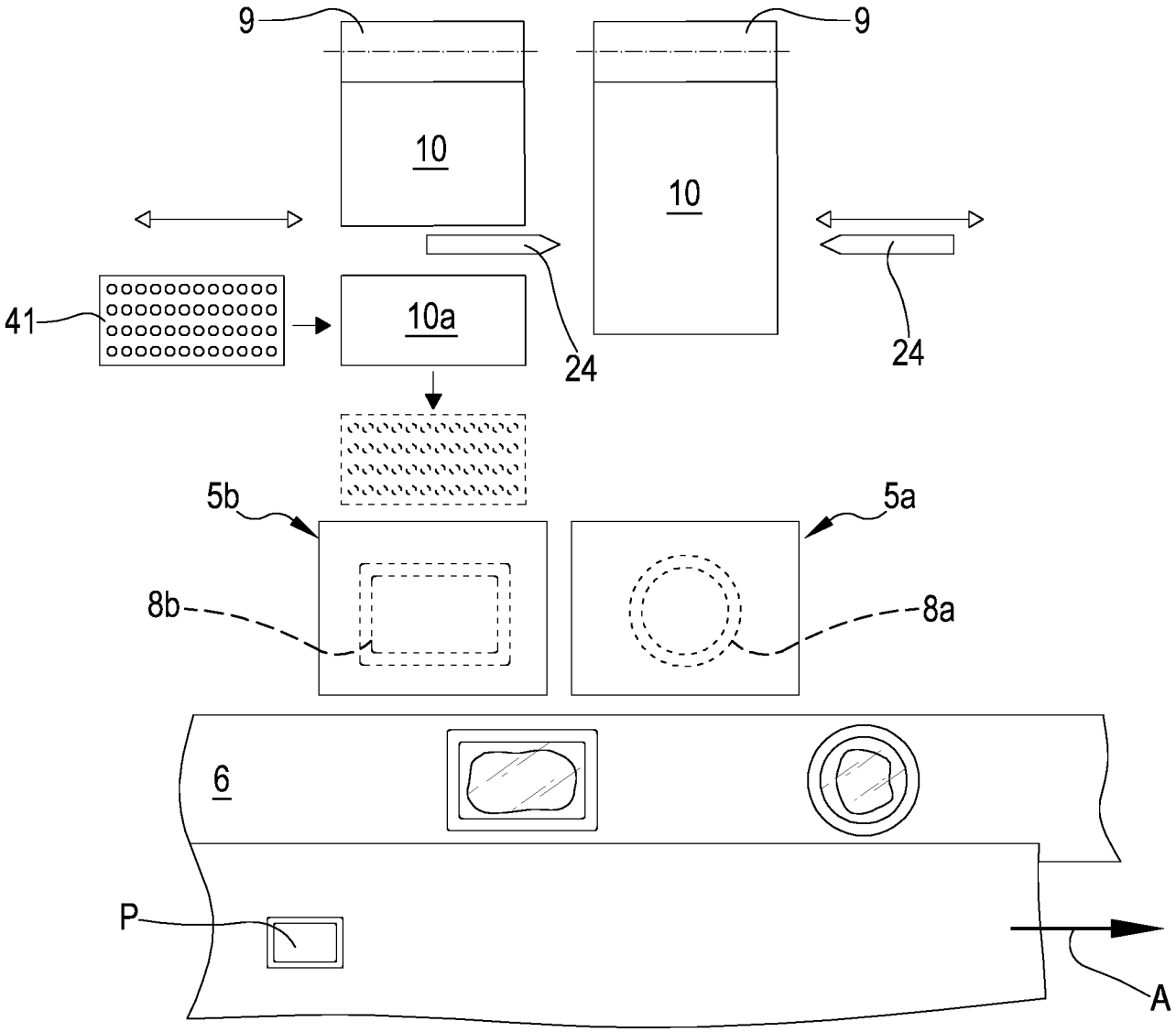
FIG. 20 is detailed schematic view of the packaging unit of FIG. 17.

The packaging facility 100 of the second embodiment has packaging units 5 where the film supply 9 comprises a film roll and is configured to provide a continuous web of film to the upper tool: each packaging unit 5 comprises a cutting device 24 configured for cutting the continuous web of film into film portions having each the size of one respective support. The cutting device may either be housed inside the packaging unit (see FIGS. 18 and 19) or be housed outside the packaging unit (see FIG. 20) between the film supply and same packaging unit so as to form pre-cut film sheets which an appropriate shuttle 41 transfers inside the packaging unit 5 at appropriate time intervals (FIG. 20).

The packaging facility 100 of the second embodiment is configured to effect a packaging process during which a multiplicity of packaging cycles are contemporaneously carried out at the plurality of packaging units 5. In greater detail, the process of packaging comprises:

- conveying the supports 4 (which includes supports alone and/or the product loaded supports) along the feed path and through the detecting station,
- identifying, among the conveyed supports 4, supports 4' of the first type and positioning one or more supports 4' of the first type in the lower tool of the first packaging units 5*a*,
- identifying, among the conveyed supports, supports 4" of the second type and positioning one or more supports 4" of the second type in the lower tool of the second packaging units 5*b*,
- having each of the first packaging units 5*a* execute a respective packaging cycle using the supports 4' of the first type, which includes: positioning the film portion 10*a* above the one or more product loaded supports positioned in the respective seat of the lower tool, and tightly fixing the film portion 10*a* to said one or more supports 4' of the first type present in the lower tool to form one or more packages with supports of the first type,
- having each of the second packaging units 5*b* execute said packaging cycle using the supports 4" of the second type, which includes: positioning the film portion 10*a* above the one or more product loaded supports positioned in the respective seat of the lower tool, and tightly fixing the film portion 10*a* to said one or more supports 4" of the second type present in the lower tool to form one or more packages with supports of the second type.

The step of identifying may be executed by the detector 12 described above in cooperation with the control system. Moreover, the step of positioning the packages of a certain type in the appropriate lower tool may be executed by the sorting system 14 in cooperation with the control system as discussed above.

In case the lower tool of each of the packaging units has adjustable seats, the process comprises adjusting the seats of a number of packaging units to receive supports 4' of a first type and adjusting the seats of a number of packaging units to receive the supports 4" of a second type. Each packaging unit 5 is equipped with a respective control device communicating with the facility control system or part of the facility control system and configured to receive the described control signal and to automatically adjust the seats in the lower tool based on the type of detected support. In this case the packaging cycle at each unit comprises the following further steps:

- receiving the control signal at one or more of the packaging units, automatically adjusting, by the one or more packaging units which received the control signal, the respective seats in the lower tool based on the type of detected support.

Finally, in case the facility includes one or more sensors for detecting fault conditions, then the process comprises detecting when one of said packaging units is in an alarm condition (see above explaining that said step of detecting an alarm condition is preferably executed by a/the control device associated to each one of the packaging units and configured for issuing a corresponding alarm signal and to send it to the control system upon detection of one of said alarm conditions being present in the respective packaging unit), and controlling the sorting device such as to avoid positioning one or more supports or product loaded supports in the lower tool of the packaging units for which the alarm condition has been detected.

Control System and Control Units

In the above description and in the claims it is indicated that the control system of the facility may include one or more control units 13. The single packaging units may include an own control device formed by one or more control units 13. The control system of the facility (1, 100), the control device of the single control unit are configured to communicate either by means of a wired and/or wireless connection. This control unit 13 or these control units 13 may each comprise a digital processor (CPU) with memory (or memories), an analogical type circuit, or a combination of one or more digital processing units with one or more analogical processing circuits. In the present description and in the claims it is indicated that the control unit(s) is/are "configured" or "programmed" to execute certain steps: this may be achieved in practice by any means which allow configuring or programming the control unit. For instance, in case of a control unit comprising one or more CPUs, one or more programs are stored in an appropriate memory: the program or programs containing instructions which, when executed by the control unit, cause the control unit to execute the steps described and/or claimed in connection with the control unit. Alternatively, if the control unit is of an analogical type, then the circuitry of the control unit is designed to include circuitry configured, in use, to process electric signals such as to execute the control unit steps herein disclosed.

The invention claimed is:

1. A process of packaging a product on a support wherein the process uses a plurality of supports, wherein the plurality of supports comprises supports of a first type and supports of a second type differing from the supports of the first type at least in one geometric property;

wherein the process of packaging uses a modular packaging facility comprises:

a plurality of independent packaging units configured to receive product loaded supports, wherein each of the product loaded supports includes one of the plurality of supports with a product loaded thereon; and a feed line configured to transport said product loaded supports, wherein the feed line extends along a prefixed feed path and serves the plurality of independent packaging units positioned along the feed line, wherein each one of said plurality of independent packaging units comprises:

a lower tool having one or more seats to receive one or more of the product loaded supports, a film supply configured to supply a film to be applied to said one or more of the product loaded supports, an upper tool cooperating with the lower tool, wherein the upper tool and the lower tool are relatively movable with respect to each other between at least a first position, which allows placement of the one or more of the product loaded supports in the one or more seats of the lower tool, and a second position, allowing coupling of a film portion of said film to said one or more of the product loaded supports received by the lower tool, wherein said packaging units in the packaging facility comprise:

a first packaging unit, wherein the lower tool of the first packaging unit has at least one first seat configured to receive one of the supports of the first type, and a second packaging unit, wherein the lower tool of the second packaging unit has at least one second seat different from the first seat at least in term of at least one geometric property and configured to receive one of the supports of the second type, wherein, for each of said plurality of distinct packaging units, the process of packaging comprises executing a respective packaging cycle including the following steps:

positioning the film portion above the one or more of the product loaded supports received in the one or more seats of the lower tool, tightly fixing the film portion to said one or more of the product loaded supports received in the lower tool to form one or more packages, and detecting when one of said packaging units is in an alarm condition, wherein the alarm condition is at least one of the following:

the packaging unit is not operative, the packaging unit is not provided with a sufficient supply of plastic film, or the packaging unit is experiencing a fault condition, wherein said step of detecting an alarm condition is executed by a control device, wherein the control device is configured to issue a corresponding alarm signal and to send the corresponding alarm signal to a control system in response to detection of the alarm condition, further wherein the packaging process provides for the control system to control a sorting device.

2. The process of claim 1 further comprising:

identifying the supports of the first type and positioning one or more of the supports of the first type in the lower tool of the first packaging unit, and having the first packaging unit execute said packaging cycle using the one or more of the supports of the first type, identifying the supports of the second type and positioning one or more of the supports of the second type in the lower tool of the second packaging unit, and having the second packaging unit execute said packaging cycle using the one or more of the supports of the second type.

3. The process of claim 2, wherein the facility comprises:

a detector operative at a detecting station located at, or in proximity of, the feed line and positioned upstream of the packaging units with respect to a direction of displacement of the product loaded supports along the feed path, said detector being configured to:

detect at least one of: an identifying information carried by the product loaded support or a characteristic property of the product loaded support, said identifying information or said characteristic property being sufficient to identify a support type of the product loaded support, and issue a corresponding detection signal; and wherein said control device is connected to the detector and is further configured to:

receive from the detector the detection signal, determine based on said identifying information or on said detected characteristic property contained in the detection signal, a type of a detected support, and issue at least one control signal in the group of:

a signal indicative of the type of detected support, or a command indicative of the packaging unit to be used with the detected support;

wherein the sorting device is connected to and controlled by said control system and the sorting device is configured to:

receive said control signal from the control unit, and based on said control signal, position one or more supports in the corresponding packaging unit.

4. The process of claim 3, wherein the sorting has a sorting control device connected to the facility control system and configured to:

receive the control signal from said control device, based on said control signal, position the one of the supports of the first type in the lower tool of the first packaging unit and the one of the supports of the second type in the lower tool of the second packaging unit, wherein the process further comprises:

receiving the control signal at the sorting device, and automatically positioning the product loaded supports in the lower tool of one of the first and second packaging units based on the type of detected support.

5. The process of claim 4, wherein the sorting system includes at least one robotized handler configured to pick a support, or a product loaded support, form the feed line and move it into the lower tool of one of the packaging units.

6. The process of claim 1, wherein the product loaded supports are positioned into the seats of the lower tool of the packaging units manually by an operator.

7. A modular packaging facility comprising:

a plurality of independent packaging units each configured to receive one or more product loaded supports; and at least one feed line configured to receive and transport said product loaded supports, wherein the feed line extends along a prefixed feed path and serves the plurality of packaging units positioned along the feed line, wherein each of said packaging units comprises:

a lower tool having one or more seats to receive one or more of the product loaded supports, a film supply configured to supply a film to be applied to said one or more of the product loaded supports, an upper tool cooperating with the lower tool, wherein the upper tool and the lower tool are relatively movable with respect to each other between at least a first position, which allows placement of the one or more of the product loaded supports in the one or more seats of the lower tool, and a second position, allowing coupling of a film portion of said film to said one or more of the product loaded supports received by the lower tool, further wherein the packaging units of the facility comprise a first packaging unit, wherein the lower tool of the first packaging unit has at least one first seat configured to receive one of the supports of a first type, and a second packaging unit, wherein the lower tool of the second packaging unit has at least one second seat configured to receive one of the supports of a second type, the supports of the first type differing from the supports of the second type at least in one geometric property;

wherein the packaging facility further comprises:

a detector operative at a detecting station located at, or in proximity of, the feed line and positioned upstream of the packaging units with respect to a direction of displacement of the product loaded supports along the feed path, said detector being configured to:

detect at least one of: an identifying information carried by the product loaded support or a characteristic property of the product loaded support, said identifying information or said characteristic property being sufficient to identify a type of the product loaded support, and issue a corresponding detection signal;

a control device connected to the detector and configured to:

receive from the detector the detection signal, and determine, based on said identifying information or on said detected characteristic property contained in the detection signal, a type of a detected support;

wherein said at least one control unit is configured to issue at least one control signal in the group of:

a signal indicative of the type of the detected support, a command indicative of the packaging unit to be used with the detected support;

wherein the facility includes a sorting device connected to and controlled by a control system and configured to:

receive said control signal from the control unit, and based on said control signal, position one or more of the product loaded supports in the corresponding packaging unit;

wherein said at least one control unit is configured to issue at least one control signal in the group of:

a signal indicative of the type of detected support, or a command indicative of the packaging unit to be used with the detected support;

wherein the facility includes a sorting device connected to and controlled by said control system and configured to:

receive said control signal from the control unit, and based on said control signal, position one or more of the product loaded supports in the corresponding packaging unit;

wherein the sorting system has a own control device connected to the facility control system and configured to:

receive the control signal from said control unit, and based on said control signal, position one of the product loaded supports of the first type in the lower tool of the first packaging unit and the one of the product loaded supports of the second type in the lower tool of the second packaging unit;

wherein the sorting system includes at least one robotized handler configured to pick one of the product loaded supports form the feed line and move it into the lower tool of one of the packaging units.

8. The packaging facility of claim 7, wherein each packaging unit includes a number of sensors connected with the control device and wherein the sensors are configured to:

detect when one of the packaging units falls in an alarm condition, wherein the alarm condition includes at least one of:

the packaging unit is not operative, the packaging unit is not provided with a sufficient supply of plastic film, or the packaging unit is experiencing a fault condition; and issue corresponding warning signals, wherein the control device is connected to the control system of the facility and is configured to receive said warning signals and to issue corresponding alarm signals to said control unit of the facility, and wherein the control system of the facility is configured to control the sorting device to prevent positioning of one or more of the product loaded supports in the lower tool of a packaging unit for which the alarm condition has been detected.

9. A process of packaging a product on a support using a modular packaging facility, the facility comprising:

a plurality of independent packaging units configured to receive product loaded supports; and a feed line configured to transport said product loaded supports, wherein the feed line extends along a prefixed feed path and serves the plurality of independent packaging units positioned along the feed line, wherein each of said plurality of independent packaging units has:

a lower tool having one or more seats to receive one or more of the product loaded supports, a film supply configured to supply a film to be applied to said one or more of the product loaded supports, an upper tool cooperating with the lower tool, wherein the upper tool and the lower tool are relatively movable with respect to each the other between at least a first position, which allows placement of the one or more of the product loaded supports in the one or more seats of the lower tool, and a second position, allowing coupling of a film portion of said film to said one or more of the product loaded supports received by the lower tool, at least one arrangement in the group of:

a vacuum arrangement configured to remove gas from a volume between each of the one or more product loaded supports received by the lower tool and the respective film portion, and a controlled atmosphere arrangement configured to inject a controlled gas composition in said volume;

wherein, for each of said plurality of independent packaging units, the process of packaging comprises executing a respective packaging cycle including the following steps:

positioning each of the one or more of the product loaded supports in one of the one or more seats of the lower tool, positioning the film portion above the one or more of the product loaded supports, removing gas from or injecting a controlled gas composition into said volume between each product loaded support and the respective film portion at least in part through:

one or more through holes formed in each of said one or more of the product loaded supports, or a nozzle inserted between each of the one or more of the product loaded supports and the respective film portion;

tightly fixing the film portion to said one or more of the product loaded supports present in the lower tool to form one or more packages;

wherein the process of packaging further comprises:

displacing the one or more of the product loaded supports along the feed path of the feed line, such that each independent packaging unit is periodically approached by one or more of said product loaded supports, periodically picking from the feed line the one or more product loaded supports and placing the one or more of the product loaded supports in the one or more seats of the lower tool in said packaging unit, executing said packaging cycle, and extracting the packages from each packaging unit;

wherein the process further comprises detecting when one of said packaging units is in an alarm condition, the alarm condition being at least one of:

the packaging unit is not operative, the packaging unit is not provided with a sufficient supply of plastic film, or the packaging unit is experiencing a fault condition;

wherein said step of detecting when the one of said packaging units is in the alarm condition is executed by a control device that is in communication with a control system of the facility, the control device being configured to issue a corresponding alarm signal and to send the corresponding alarm to the control system upon detection of the alarm condition, further wherein the packaging process provides for the control system to control the sorting device to avoid positioning any of the one or more product loaded supports in the lower tool of the packaging units for which the alarm condition has been detected.

10. The process of claim 9, wherein the plurality of packaging units are positioned adjacent to the feed line, and wherein on a same side of the feed line each two consecutive packaging units execute the respective packaging cycle such that while in one of said two consecutive packaging units one or more of the following steps are taking place:

positioning each of the one or more product loaded supports in the respective seat of the lower tool, and positioning the film portion above the one or more product loaded supports, while in the other of the two consecutive packaging units one or more of the following steps are taking place:

removing gas from or injecting a controlled gas composition into said volume between each product loaded support and the respective film portion, and tightly fixing the film portion to said one or more supports present in the lower tool to form one or more packages.

11. The process of claim 9, wherein the feed line comprises:

a conveyor configured to displace the one or more of the product loading supports, a motor connected to the conveyor and driving the conveyor in motion, and a control unit active on the motor and configured to control the conveyor to move either in a step by step manner or at a predetermined constant speed;

wherein the process comprises using the conveyor to move the one or more of the product loaded supports along the feed path either in a step by step manner or at a predetermined constant speed so as to serve each one of the packaging units positioned along the feed path.

12. The process of claim 9, wherein the product loading supports are each one of two or more types, wherein the product loading supports of two or more types at least comprise product loading supports of a first type and product loading supports of a second type differing from the product loading supports of the first type at least in one geometric property; wherein said packaging facility comprises:

a first packaging unit, wherein the lower tool of the first packaging unit has at least one first seat configured to receive one of the supports of the first type, and a second packaging unit, wherein the lower tool of the second packaging unit has at least one second seat different from the first seat at least in term of at least one geometric property and configured to receive one of the supports of the second type, and wherein the process comprises:

conveying along the feed path the product loading supports of the first type and the product loading supports of the second type, identifying the product loading supports of the first type and positioning one or more supports of the product loading supports of the first type in the lower tool of the first packaging unit, and identifying the product loading supports of the second type and positioning one or more supports of the product loading supports of the second type in the lower tool of the second packaging unit.

13. The process of claim 9, wherein the product loaded supports are positioned into the seats of the lower tool is manually executed by an operator.

* * * * *